US008580385B2

(12) United States Patent
Kitagawa et al.

(10) Patent No.: US 8,580,385 B2
(45) Date of Patent: Nov. 12, 2013

(54) MULTILAYER COATING FILM-FORMING METHOD

(75) Inventors: Hiroshi Kitagawa, Hiratsuka (JP); Munehiro Nakata, Hiratsuka (JP); Daisuke Takayama, Hiratsuka (JP); Tatsuya Azuma, Hiratsuka (JP)

(73) Assignee: Kansai Paint Co., Ltd., Hyogo (JP)

( * ) Notice: Subject to any disclaimer, the term of this patent is extended or adjusted under 35 U.S.C. 154(b) by 0 days.

(21) Appl. No.: 13/143,812

(22) PCT Filed: Jan. 14, 2010

(86) PCT No.: PCT/JP2010/050356
§ 371 (c)(1),
(2), (4) Date: Jul. 8, 2011

(87) PCT Pub. No.: WO2010/082607
PCT Pub. Date: Jul. 22, 2010

(65) Prior Publication Data

US 2012/0021228 A1 Jan. 26, 2012

(30) Foreign Application Priority Data

Jan. 15, 2009 (JP) ..... 2009-006462

(51) Int. Cl.
*B05D 1/36* (2006.01)
*B05D 7/16* (2006.01)

(52) U.S. Cl.
USPC ..... 428/411.1; 427/407.1

(58) Field of Classification Search
USPC ..... 427/407.1–412.5, 372.2; 428/411.1–704
See application file for complete search history.

(56) References Cited

U.S. PATENT DOCUMENTS

2004/0228975 A1 11/2004 Takesako et al.

FOREIGN PATENT DOCUMENTS

| | | |
|---|---|---|
| JP | 2004-358462 | 12/2004 |
| JP | 2005-2252 | 1/2005 |
| JP | 2005-89613 | 4/2005 |
| JP | 2007-283271 | 11/2007 |
| JP | 2007-297545 | 11/2007 |

OTHER PUBLICATIONS

International Preliminary Report on Patentability for PCT/JP2010/050356, Aug. 16, 2011, 8 pages.*
English machine translation of the Detailed Description of JP 2004-358462 A, generated Aug. 23, 2012, 21 pages.*
International Search Report issued Feb. 16, 2010 in International (PCT) Application No. PCT/JP2010/050356.

* cited by examiner

*Primary Examiner* — William Phillip Fletcher, III
(74) *Attorney, Agent, or Firm* — Wenderoth, Lind & Ponack, L.L.P.

(57) ABSTRACT

An object to be achieved by the present invention is to provide a method capable of forming a multilayer coating film having excellent smoothness, distinctness of image, and chipping resistance, by a 3-coat 1-bake process comprising successively applying an aqueous first colored coating composition, an aqueous second colored coating composition, and a clear coating composition to a substrate, and heat-curing the resulting three layers of the multilayer coating film all at once. The present invention provides a method for forming a multilayer coating film, which employs a 3-coat 1-bake process comprising sequentially applying an aqueous first colored coating composition (X), an aqueous second colored coating composition (Y), and a clear coating composition (Z) on a substrate; and heat-curing the resulting three layers of the multilayer coating film all at once, wherein the aqueous first colored coating composition (X) contains an acrylic resin (A), a curing agent (B), and a urethane resin emulsion (C), and a first colored coating film formed from the aqueous first colored coating composition (X) has a water swelling rate of 100% or less and an organic solvent swelling rate of 300% or less.

10 Claims, No Drawings

MULTILAYER COATING FILM-FORMING METHOD

TECHNICAL FIELD

The present invention relates to a method for forming a multilayer coating film having excellent appearance, by a 3-coat-1-bake process comprising successively applying an aqueous first colored coating composition, an aqueous second colored coating composition, and a clear coating composition to a substrate, and heat-curing the resulting three layers of the multilayer coating film all at once.

BACKGROUND ART

A method for forming a multilayer coating film by a 3-coat-2-bake (3C2B) process is widely used as a method for forming a coating film on automobile bodies. This method comprises the following steps after applying electrodeposition coating to a substrate: application of an intermediate coating composition→curing by baking→application of an aqueous base coating composition→preheating (preliminary heating)→application of a clear coating composition→curing by baking. However, in recent years, for the purpose of saving energy, attempts have been made to omit the bake-curing step that is performed after applying the intermediate coating composition and use a 3-coat-1-bake (3C1B) process comprising the following steps after applying electrodeposition coating to a substrate: application of an aqueous intermediate coating composition→preheating (preliminary heating)→application of an aqueous base coating composition→preheating (preliminary heating→application of a clear coating composition→curing by baking (for example, Patent Literature 1).

In view of controlling the environmental pollution caused by the vaporization of organic solvents, the establishment of a 3-coat-1 bake process using aqueous coating compositions as the intermediate coating composition and the base coating composition is particularly desired.

The 3-coat-1-bake process using an aqueous intermediate composition and an aqueous base coating composition has the following drawback due to the use of water as a main solvent in the composition. When an aqueous base coating composition is applied to an intermediate coating film, the intermediate coating film is dissolved by the water contained in the aqueous base coating composition, thus forming a mixed layer at the interface between the intermediate and base coating films and resulting in a coating film having low smoothness, low distinctness of image, etc. Accordingly, it is considered to be effective to reduce the water absorption rate of the intermediate coating film (Patent Literature 1).

However, simply adjusting the water absorption rate of the intermediate coating film is not enough. In some cases, disadvantageously, a solvent contained in the clear coating composition permeates and swells the intermediate coating film and the base coating film, causing the formation of minute surface roughness; and the resulting multilayer coating film has a poor finished appearance due to reduced smoothness and distinctness of image.

Further, the coating layer formed by the above conventional method was also insufficient in terms of chipping resistance.

CITATION LIST

Patent Literature

PTL 1: Japanese Unexamined Patent Publication No. 2004-358462

SUMMARY OF INVENTION

Technical Problem

An object of the present invention is to provide a method capable of forming a multilayer coating film having excellent smoothness, distinctness of image, and chipping resistance, by a 3-coat 1-bake process comprising successively applying an aqueous first colored coating composition, an aqueous second colored coating composition, and a clear coating composition to a substrate, and heat-curing the resulting three layers of the multilayer coating film all at once.

Solution to Problem

The present inventors conducted extensive research to achieve the above object, and as a result, found that a multilayer coating film having excellent smoothness, distinctness of image, and chipping resistance can be formed by the following method for forming a multilayer coating film, which employs a 3-coat 1-bake process comprising sequentially applying an aqueous first colored coating composition, an aqueous second colored coating composition, and a clear coating composition on a substrate; and heat-curing the resulting three layers of the multilayer coating film all at once, wherein an aqueous first colored coating composition (X) contains an acrylic resin (A), a curing agent (B), and a urethane resin emulsion (C), and a first colored coating film formed from the aqueous first colored coating composition (X) has a water swelling rate of 100% or less and an organic solvent swelling rate of 300% or less before a second base is applied. The present invention is accomplished based on the above finding.

Specifically, the present invention provides the following items:

Item 1. A method for forming a multilayer coating film comprising sequentially performing the following steps (1) to (4) on a substrate:

step (1): forming a first colored coating film by applying an aqueous first colored coating composition (X);

step (2): forming a second colored coating film by applying an aqueous second colored coating composition (Y) on the first colored coating film formed in step (1);

step (3): forming a clear coating film by applying a clear coating composition (Z) on the second colored coating film formed in step (2); and step (4): bake-drying the first colored coating film, the second colored coating film, and the clear coating film formed in steps (1) to (3) all at once, wherein the aqueous first colored coating composition (X) is an aqueous coating composition comprising an acrylic resin (A), a curing agent (B), and a urethane resin emulsion (C), and the first colored coating film formed from the aqueous first colored coating composition (X) has a water swelling rate of 100% or less and an organic solvent swelling rate of 300% or less.

Item 2. The method for forming a multilayer coating film according to Item 1, wherein the urethane resin emulsion (C) is produced using a polyisocyanate component and a polyol component as starting materials, and the polyol component is used in an amount of 40 to 90 mass % relative to the total mass of the polyisocyanate component and the polyol component.

Item 3. The method for forming a multilayer coating film according to Item 1 or 2, wherein the urethane resin emulsion (C) is produced using a polyisocyanate component and a polyol component as starting materials; the polyisocyanate component contains an alicyclic diisocyanate; the polyol component contains a hydrophobic diol; and 50 mass % or more of the starting compounds of the hydrophobic diol is a compound having a hydrocarbon group having 6 or more carbons.

Item 4. The method for forming a multilayer coating film according to Item 3, wherein the hydrophobic diol is a polycarbonate diol.

Item 5. The method for forming a multilayer coating film according to Item 3, wherein the compound having a hydrocarbon group having 6 or more carbons is at least one selected from the group consisting of 1,6-hexanediol and 1,4-cyclohexane dimethanol.

Item 6. The method for forming a multilayer coating film according to any one of Items 1 to 5, wherein the acrylic resin (A) comprises a copolymer obtained through emulsion polymerization of a polymerizable unsaturated monomer mixture having an alkyl(meth)acrylate monomer having a $C_{4-14}$ alkyl group in an amount of 30 to 80 mass % relative to the total amount of polymerizable unsaturated monomers.

Item 7. The method for forming a multilayer coating film according to any one of Items 1 to 6, wherein the curing agent (B) is at least one compound selected from the group consisting of a melamine resin (b-1), a polyisocyanate compound (b-2), a blocked polyisocyanate compound (b-3), and a carbodiimide group-containing compound (b-4).

Item 8. The method for forming a multilayer coating film according to any one of Items 1 to 7, wherein the aqueous first colored coating composition (X) comprises 20 to 70 mass % of the acrylic resin (A), 5 to 20 mass % of the curing agent (B), and 10 to 50 mass % of the urethane resin emulsion (C), based on the total weight of the solids content of the acrylic resin (A), the curing agent (B), and the urethane resin emulsion (C).

Item 9. An article coated by the method for forming a multilayer coating film according to any one of Items 1 to 8.

Advantageous Effects of Invention

The method for forming a multilayer coating film of the present invention is mainly characterized by that a first colored coating film formed from the aqueous first colored coating composition (X) has a water swelling rate of 100% or less and an organic solvent swelling rate of 300% or less. Because the first colored coating film has a water swelling rate of 100% or less, the formation of a mixed layer of the first colored coating film and the second colored coating film can be prevented. Further, because the first colored coating film has an organic solvent swelling rate of 300% or less, it is possible to prevent the formation of minute surface roughness, which is a cause of a poor finished appearance of the first colored coating film and the second colored coating film, and which is caused by an organic solvent that permeates and swells the first colored coating film and the second colored coating film when the clear coating composition is applied.

Accordingly, the method for forming a multilayer coating film of the present invention achieves the effect of forming a multilayer coating film having excellent smoothness, distinctness of image, and chipping resistance.

DESCRIPTION OF EMBODIMENTS

Hereinafter, the method for forming a multilayer coating film of the present invention is further described in detail, sequentially following each step.

Step (1)

According to the method for forming a multilayer coating film of the present invention, first, an aqueous first colored coating composition (X) comprising an acrylic resin (A), a curing agent (B), and a urethane resin emulsion (C) is applied to a substrate.

Substrate

The substrate to be coated with the aqueous first colored coating composition (X) is not particularly limited. Examples of substrates include exterior panel parts of automobile bodies such as passenger cars, trucks, motorcycles, and buses; automotive components such as bumpers; exterior panel parts of household electric appliances such as cellular phones and audio equipment; etc. Of these substrates, exterior panel parts of automobile bodies and automotive components are preferable.

The material for the substrate is not particularly limited. Examples of the material include metallic materials such as iron, aluminum, brass, copper, tin, stainless steel, galvanized steel, steel plated with zinc alloys (Zn—Al, Zn—Ni, Zn—Fe, etc.); plastic materials such as polyethylene resins, polypropylene resins, acrylonitrile-butadiene-styrene (ABS) resins, polyamide resins, acrylic resins, vinylidene chloride resins, polycarbonate resins, polyurethane resins, epoxy resins and like resins, mixtures of these resins, and various types of fiber-reinforced plastics (FRP); inorganic materials such as glass, cement, and concrete; wood; textile materials such as paper and cloth; etc. Of these materials, metallic materials and plastic materials are preferable.

The substrate may be a metal material as mentioned above or a metal body formed therefrom, such as a vehicle body, which may be subjected to a surface treatment, such as phosphate treatment, chromate treatment, or composite oxide treatment, and which may be further coated thereon.

Examples of the substrate having a coating film formed thereon include base materials whose surface is optionally treated and which have an undercoating film formed thereon. In particular, vehicle bodies having an undercoating film formed thereon using an electrodeposition coating composition are preferable, and those having an undercoating film formed thereon using a cationic deposition coating composition are particularly preferable.

The substrate may be a plastic material as mentioned above or a plastic member formed therefrom, such as an automotive component (or part), which may have been surface-treated or coated with a primer, etc. The substrate may be a combination of the plastic and metallic materials mentioned above.

Acrylic Resin (A)

Any water-soluble or water-dispersible acrylic resin known per se that has been used in aqueous coating compositions may be used as the acrylic resin (A). In the present invention, the acrylic resin (A) has a crosslinkable functional group such as hydroxy, carboxy, and epoxy groups, which can react with the curing agent (B). In particular, hydroxy-containing acrylic resins are preferably used.

The acrylic resin (A) can be produced by a method known per se, or a method similar thereto.

Hydroxy-containing acrylic resins can be produced by copolymerizing, for example, a hydroxy-containing polymerizable unsaturated monomer and other polymerizable unsaturated monomer copolymerizable with the hydroxy-containing polymerizable unsaturated monomer, using methods known per se, for example, a solution polymerization method in an organic solvent, an emulsion polymerization method in water, and the like.

The hydroxy-containing polymerizable unsaturated monomer is a compound having one or more hydroxy groups and one or more polymerizable unsaturated bonds per molecule. Examples thereof include monoesterified products of (meth) acrylic acid with a dihydric alcohol having 2 to 8 carbons such as 2-hydroxyethyl (meth)acrylate, 2-hydroxypropyl (meth) acrylate, 3-hydroxypropyl (meth)acrylate, and 4-hydroxybutyl (meth)acrylate; ϵ-caprolactone-modified products of the monoesterified products of (meth)acrylic acid with a dihydric alcohol having 2 to 8 carbons; N-hydroxymethyl (meth)acrylamide; allyl alcohol; (meth)acrylate having hydroxy-terminated polyoxyethylene chains; etc.

The term "(meth)acrylate" used in this specification means "acrylate or methacrylate". The term "(meth)acrylic acid" means "acrylic acid or methacrylic acid", and the term "(meth)acryloyl" means "acryloyl or methacryloyl". Additionally, the term "(meth)acrylamide" means "acrylamide or methacrylamide".

Further, the other polymerizable unsaturated monomers copolymerizable with the hydroxy-containing polymerizable unsaturated monomer may be used by being suitably selected according to the properties expected from the hydroxy-containing acrylic resins. Specific examples of the monomers are listed in (i) to (xix). These may be used singly, or in a combination of two or more.

(i) Alkyl or cycloalkyl (meth)acrylates: for example, methyl (meth)acrylate, ethyl (meth)acrylate, n-propyl (meth) acrylate, isopropyl (meth)acrylate, n-butyl (meth)acrylate, isobutyl (meth)acrylate, tert-butyl (meth)acrylate, n-hexyl (meth)acrylate, n-octyl (meth)acrylate, 2-ethylhexyl (meth) acrylate, nonyl (meth)acrylate, tridecyl (meth)acrylate, lauryl (meth)acrylate, stearyl (meth)acrylate, isostearyl (meth)acrylate, cyclohexyl (meth)acrylate, methylcyclohexyl (meth) acrylate, tert-butylcyclohexyl (meth)acrylate, cyclododecyl (meth)acrylate, tricyclodecanyl (meth)acrylate, etc.

(ii) Polymerizable unsaturated monomers having an isobornyl group: for example, isobornyl (meth)acrylate, etc.

(iii) Polymerizable unsaturated monomers having an adamantyl group: for example, adamantyl (meth)acrylate, etc.

(iv) Polymerizable unsaturated monomer having a tricyclodecenyl group: for example, tricyclodecenyl (meth)acrylate, etc.

(v) Aromatic ring-containing polymerizable unsaturated monomers: for example, benzyl(meth)acrylate, styrene, α-methyl styrene, vinyltoluene, etc.

(vi) Polymerizable unsaturated monomers having an alkoxysilyl group: for example, vinyltrimethoxysilane, vinyltriethoxysilane, vinyltris (2-methoxyethoxy)silane, γ-(meth) acryloyloxypropyltrimethoxysilane, γ-(meth) acryloyloxypropyltriethoxysilane, etc.

(vii) Polymerizable unsaturated monomers having a fluorinated alkyl group: for example, perfluoroalkyl (meth)acrylates such as perfluorobutylethyl (meth)acrylate and perfluorooctylethyl (meth)acrylate; fluoroolefin; etc.

(viii) Polymerizable unsaturated monomers having a photopolymerizable functional group such as a maleimide group.

(ix) Vinyl compounds: for example, N-vinylpyrrolidone, ethylene, butadiene, chloroprene, vinyl propionate, vinyl acetate, etc.

(x) Phosphate group-containing polymerizable unsaturated monomers: for example, 2-acryloyloxyethyl acid phosphate, 2-methacryloyloxyethyl acid phosphate, 2-acryloyloxypropyl acid phosphate, 2-methacryloyloxypropyl acid phosphate, etc.

(xi) Carboxy-containing polymerizable unsaturated monomers: for example, (meth)acrylic acid, maleic acid, crotonic acid, β-carboxyethyl acrylate, etc.

(xii) Nitrogen-containing polymerizable unsaturated monomers: for example, (meth) acrylonitrile, (meth) acrylamide, N,N-dimethylaminoethyl (meth)acrylate, N,N-diethylaminoethyl (meth)acrylate, N,N-dimethylaminopropyl (meth) acrylamide, methylene bis(meth)acrylamide, ethylene bis(meth)acrylamide, 2-(methacryloyloxy)ethyl trimethylammonium chloride, adducts of glycidyl (meth)acrylate with amines, etc.

(xiii) Polymerizable unsaturated monomers having two or more polymerizable unsaturated groups per molecule: for example, allyl (meth)acrylate, 1,6-hexanediol di(meth)acrylate, etc.

(xiv) Epoxy-containing polymerizable unsaturated monomers: for example, glycidyl (meth)acrylate, β-methylglycidyl (meth)acrylate, 3,4-epoxycyclohexylmethyl (meth) acrylate, 3,4-epoxycyclohexylethyl (meth)acrylate, 3,4-epoxycyclohexylpropyl (meth)acrylate, allyl glycidyl ether, etc.

(xv) (Meth) acrylates having alkoxy-terminated polyoxyethylene chains.

(xvi) Sulfonic acid group-containing polymerizable unsaturated monomers: for example, 2-acrylamide-2-methylpropanesulfonic acid, 2-sulfoethyl (meth)acrylate, allylsulfonic acid, 4-styrenesulfonic acid, etc.; sodium salts and ammonium salts of such sulfonic acids; etc.

(xvii) Polymerizable unsaturated monomers having an ultraviolet-absorbing functional group: for example, 2-hydroxy-4-(3-methacryloyloxy-2-hydroxypropoxy)benzophenone, 2-hydroxy-4-(3-acryloyloxy-2-hydroxypropoxy)benzophenone, 2,2'-dihydroxy-4-(3-methacryloyloxy-2-hydroxypropoxy)benzophenone, 2,2'-dihydroxy-4-(3-acryloyloxy-2-hydroxypropoxy)benzophenone, 2-(2'-hydroxy-5'-methacryloyloxyethylphenyl)-2H-benzotriazole, etc.

(xviii) Photostable polymerizable unsaturated monomers: for example, 4-(meth)acryloyloxy-1,2,2,6,6-pentamethylpiperidine, 4-(meth)acryloyloxy-2,2,6,6-tetramethylpiperidine, 4-cyano-4-(meth)acryloylamino-2,2,6,6-tetramethylpiperidine, 1-(meth)acryloyl-4-(meth)acryloylamino-2,2,6,6-tetramethylpiperidine, 1-(meth)acryloyl-4-cyano-4-(meth) acryloylamino-2,2,6,6-tetramethylpiperidine, 4-crotonoyloxy-2,2,6,6-tetramethylpiperidine, 4-crotonoylamino-2,2,6,6-tetramethylpiperidine, 1-crotonoyl-4-crotonoyloxy-2,2,6,6-tetramethylpiperidine, etc.

(xix) Carbonyl-containing polymerizable unsaturated monomers: for example, acrolein, diacetone acrylamide, diacetone methacrylamide, acetoacetoxylethyl methacrylate, formylstyrol, vinyl alkyl ketones having 4 to 7 carbon atoms (e.g., vinyl methyl ketone, vinyl ethyl ketone, vinyl butyl ketone), etc.

The other polymerizable unsaturated monomers copolymerizable with these hydroxy-containing polymerizable unsaturated monomers may be used singly, or in a combination of two or more. In particular, a combination of (i) alkyl or cycloalkyl (meth)acrylate, (v) aromatic ring-containing polymerizable unsaturated monomer, and a carboxy-containing polymerizable unsaturated monomer is preferable.

Further, examples of the hydroxy-containing acrylic resins may also include so-called urethane-modified polyester resins (excluding the later-described urethane resin emulsion (C)), in which polyisocyanate compounds are extended to higher molecular weight by urethanization reactions with some of the hydroxy groups in the hydroxy-containing acrylic resin.

The hydroxy-containing acrylic resin (A1) has a hydroxy value of 1 to 200 mg KOH/g, preferably 2 to 150 mg KOH/g, more preferably 5 to 100 mg KOH/g, in view of storage stability, water resistance of the resulting coating film, etc.

Further, the hydroxy-containing acrylic resin (A1) has an acid value of 0 to 200 mg KOH/g, preferably 0 to 100 mg KOH/g, more preferably 0 to 50 mg KOH/g, in view of water resistance of the resulting coating film and the like.

Additionally, although the weight average molecular weight of the hydroxy-containing acrylic resin (A1) is not particularly limited, it is 2,000 to 5,000,000, preferably 10,000 to 2,000,000 in view of appearance, water resistance of the resulting coating film, etc.

In the present specification, the number average molecular weight and the weight average molecular weight are converted values obtained by gel permeation chromatography using tetrahydrofuran as a solvent, and using polystyrene having a known molecular weight as a standard substance.

Water-dispersible acrylic resin particles synthesized by emulsion polymerization in water can be particularly preferably used as the acrylic resin.

The water-dispersible acrylic resin particles can be obtained, for example, by subjecting a polymerizable unsaturated monomer (e.g., a vinyl monomer as a typical example) to emulsion polymerization using a radical polymerization initiator in the presence of a dispersion stabilizer such as a surfactant.

Examples of polymerizable unsaturated monomers used for emulsion polymerization include a carboxy-containing polymerizable unsaturated monomer (M-1), a hydroxy-containing polymerizable unsaturated monomer (M-2), other polymerizable unsaturated monomer (M-3), a polyvinyl compound (M-4) having two or more polymerizable unsaturated groups per molecule, etc.

The carboxy-containing polymerizable unsaturated monomer (M-1) is a compound having one or more carboxy groups and one polymerizable unsaturated group per molecule. Examples thereof include acrylic acid, methacrylic acid, crotonic acid, maleic acid, itaconic acid, etc. Further, in the present specification, the monomer (M-1) also encompasses acid anhydrides of these compounds and monocarboxylic acids formed by half-esterification of these acid anhydrides.

Such carboxy-containing polymerizable unsaturated monomers are for introducing a carboxy group into the water-dispersible acrylic resin particles for imparting water-dispersibility thereto.

These carboxy-containing polymerizable unsaturated monomers (M-1) may be used singly, or in a combination of two or more.

The hydroxy-containing polymerizable unsaturated monomer (M-2) is a compound having one hydroxy group and one polymerizable unsaturated group per molecule. The hydroxy group can act as a functional group to react with a cross-linking agent. Specifically, monoesterified products of acrylic acid or methacrylic acid with a dihydric alcohol having 2 to 10 carbons are preferable as the above monomers. Examples thereof include hydroxy-containing acrylate monomers such as 2-hydroxyethyl acrylate, 2-hydroxypropyl acrylate, 3-hydroxypropyl acrylate, and 4-hydroxybutyl acrylate; hydroxy-containing methacrylate monomers such as 2-hydroxyethyl methacrylate, 2-hydroxypropyl methacrylate, 3-hydroxypropyl methacrylate, and 4-hydroxybutyl methacrylate; N-methylolacrylamide; N-methylolmethacrylamide; etc.

These hydroxy-containing polymerizable unsaturated monomers (M-2) may be used singly, or in a combination of two or more.

The other polymerizable unsaturated monomer (M-3) is a compound different from the monomers (M-1) and (M-2), which has one polymerizable unsaturated group per molecule. Specific examples thereof are listed in (1) to (8) below.

(1) Alkyl (meth)acrylate monomers (specifically, monoesterified products of acrylic acid or methacrylic acid with a monohydric alcohol having 1 to 20 carbons): for example, methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, cyclohexyl acrylate, cyclohexyl methacrylate, lauryl acrylate, lauryl methacrylate, stearyl acrylate, stearyl methacrylate, etc.

Of the above alkyl (meth)acrylate monomers, an alkyl (meth)acrylate monomer having a $C_{4-14}$ alkyl group, preferably a $C_{4-8}$ alkyl group, is preferably used, in view of the water swelling rate and solvent swelling rate.

When an alkyl (meth)acrylate monomer having a $C_{4-14}$ alkyl group is used as a copolymerization component, the copolymerization amount is preferably 30 to 80 mass % based on the total amount of the polymerizable unsaturated monomers.

(2) Aromatic vinyl monomers: for example, styrene, α-methylstyrene, vinyltoluene, etc.

(3) Glycidyl-containing vinyl monomers: compounds having one or more glycidyl groups and one polymerizable unsaturated bond per molecule; specific examples thereof include glycidyl acrylate, glycidyl methacrylate, etc.

(4) Nitrogen-containing alkyl ($C_{1-20}$) (meth)acrylates: for example, dimethylaminoethyl acrylate, dimethylaminoethyl methacrylate, etc.

(5) Polymerizable unsaturated group-containing amide compounds: compounds having one or more amide groups and one polymerizable unsaturated bond per molecule; examples thereof include acrylamide, methacrylamide, dimethylacrylamide, N,N-dimethylpropylacrylamide, N-butoxymethylacrylamide, diacetoneacrylamide, etc.

(6) Polymerizable unsaturated group-containing nitrile compounds: for example, acrylonitrile, methacrylonitrile, etc.

(7) Diene compounds: for example, butadiene, isoprene, etc.

(8) Vinyl compounds: for example, vinyl acetate, vinyl propionate, vinyl chloride, etc.

These other vinyl monomers (M-3) may be used singly, or in combination.

The polyvinyl compound (M-4) is a compound having two or more polymerizable unsaturated groups per molecule. Examples thereof include ethylene glycol diacrylate, ethylene glycol dimethacrylate, triethylene glycol diacrylate, tetraethylene glycol dimethacrylate, 1,6-hexanediol diacrylate, allyl methacrylate, allyl acrylate, divinylbenzene, trimethylolpropane triacrylate, methylene bis(meth)acrylamide, ethylene bis(meth)acrylamide, etc. The polyvinyl compounds (M-4) do not encompass the above-mentioned diene compounds.

These polyvinyl compounds (M-4) may be used singly, or in a combination of two or more.

The amount of each polymerizable unsaturated monomer used in the water-dispersible acrylic resin particles is not particularly limited insofar as the water swelling rate and the organic solvent swelling rate of the first colored coating film formed from the ultimately resulting aqueous first colored coating composition (X) are in the above-described ranges. A preferable amount is as follows: The usable amount of the carboxy-containing polymerizable unsaturated monomer (M-1) is preferably 0.1 to 25 mass %, more preferably 0.1 to 10 mass %, further particularly preferably 0.5 to 5 mass %, based on the total amount of the polymerizable unsaturated monomers, in view of water dispersibility and water resistance of the polymer particles, etc. Although the usable amount of the hydroxy-containing polymerizable unsaturated monomer (M-2) varies depending on the type and amount of curing agent used, it is preferably 0.1 to 40 mass %, more preferably 0.1 to 25 mass %, further particularly preferably 1 to 10 mass %, based on the total amount of the polymerizable unsaturated monomers, in view of curability, water resistance of the coating film, and the like. Although the other polymerizable unsaturated monomers (M-3) can be suitably used in such a manner that the total amount of the polymerizable unsaturated monomers reaches 100 mass %, the amount thereof is preferably 20 to 99.8 mass %, more preferably 30 to 80 mass %, based on the total amount of the polymerizable unsaturated monomers.

The polyvinyl compound (M-4) is used, if necessary. The amount thereof is 0 to 15 mass %, preferably 0 to 10 mass %, more preferably 0 to 5 mass %, based on the total amount of the polymerizable unsaturated monomers.

Examples of the above dispersion stabilizers include anionic emulsifiers, nonionic emulsifiers, zwitterionic emulsifiers, etc. Specific examples of anionic emulsifiers include fatty acids, salts of alkyl sulfuric acid ester, alkylbenzene sulfonates, alkyl phosphates, etc. Examples of nonionic emulsifiers include polyoxyethylene compounds such as polyoxyethylene alkylether, polyoxyethylene alkylarylether polyoxyethylene alkylamine, and polyoxyethylene sorbitan fatty acid ester; sorbitan fatty acid esters; alkyl alkanol amides; etc. Examples of zwitterionic emulsifiers include alkylbetaine and the like.

Note that reactive emulsifiers are particularly suitably used as the dispersion stabilizer in view of copolymerizability in an emulsion polymerization reaction with a vinyl monomer for forming the water-dispersible acrylic resin particles; dispersion stability of the water-dispersible acrylic resin particles in the first colored coating composition; coating film performance such as water resistance of a multilayer coating film obtained by the present invention; reduction in residual monomers for environmental protection; etc. The reactive emulsifiers are emulsifiers having radical reactivity with vinyl monomers. In other words, they are surfactants having a polymerizable unsaturated group per molecule.

Specific examples of reactive emulsifiers include Eleminol JS-1, Eleminol JS-2 (Sanyo Chemical Industries, Ltd.), S-120, S-180A, S-180, Latemul PD-104, Latemul PD-420, Latemul PD-430S, Latemul PD-450 (Kao Corporation), Aqualon HS-10, Aqualon KH-10 (Dai-Ichi Kogyo Seiyaku Co., Ltd.), Adekaria Soap SE-10N, Adekaria Soap SE-20N, Adekaria Soap SR-1025, Adekaria Soap ER-10, Adekaria Soap ER-20, Adekaria Soap ER-30, Adekaria Soap ER-40 (Asahi Denka Kogyo K.K.), ANTOX MS-60 (Nippon Nyukazai Co., Ltd.), etc.

The dispersion stabilizers such as the above emulsifiers may be used singly, or in a combination of two or more in emulsion polymerization reaction.

The amount of the dispersion stabilizer used is preferably 0.1 to 10 mass %, particularly 1 to 7.5 mass %, further particularly 1.5 to 6 mass %, relative to the water-dispersible acrylic resin particles that are produced.

Further, when a reactive emulsifier is used as the dispersion stabilizer, the amount of the reactive emulsifier used is preferably 0.1 to 10 mass %, particularly 1.5 to 7.5 mass %, further particularly 2 to 6 mass %, relative to the water-dispersible acryl polymer particles that are produced.

Further, examples of radical polymerization initiators include peroxides typified by ammonium persulfate, potassium persulfate, and ammonium peroxide; so-called redox initiators in which the above peroxides are combined with reducing agents such as sodium hydrogen sulfite, sodium thiosulfate, rongalite, and ascorbic acid; and azo compounds such as 2,2'-azobisisobutyronitrile, 4,4'-azobis(4-cyanopentanoic acid), and 2,2'-azobis[2-methyl-N-(2-hydroxyethyl)-propion amide]. Of these, azo compounds are preferable.

A suitable amount of the radical polymerization initiator is usually 0.1 to 5.0 mass %, preferably 0.1 to 3.0 mass %, more preferably 1 to 3.0 mass %, relative to the total weight of the solids content of the polymerizable unsaturated monomers for forming the water-dispersible acrylic resin particles.

The concentration of all radical-polymerizable unsaturated monomers in an emulsion polymerization reaction is usually in the range of 0.1 to 60 mass %, preferably 0.5 to 50 mass %, more preferably 1.0 to 50 mass %.

Although the reaction temperature during emulsion polymerization varies depending on the type of radical polymerization initiator used, it can usually be set to 40° C. to 100° C., preferably 50° C. to 90° C., more preferably 60° C. to 80° C.

The reaction time is usually 3 to 24 hours, preferably 5 to 20 hours, more preferably 7 to 16 hours.

The water-dispersible acrylic resin particle may have an ordinary homogeneous structure, or a multilayer structure such as a core/shell structure.

Specifically, the water-dispersible acrylic resin particle having a core/shell structure can be obtained by, for example, first emulsion-polymerizing a polymerizable unsaturated monomer component that is entirely or substantially free of the carboxy-containing polymerizable unsaturated monomer (M-1) (for example, the content of the carboxy-containing polymerizable unsaturated monomer (M-1) is 1 mass % or less, relative to the total amount of monomers forming the core component), and then adding a polymerizable unsaturated monomer component containing a large amount of carboxy-containing polymerizable unsaturated monomers (M-1) to perform emulsion polymerization.

The core can be bonded to the shell, for example, by copolymerizing a polymerizable unsaturated bond of allyl acrylate, allyl methacrylate, etc. remaining on the surface of the core, with a polymerizable unsaturated monomer component containing the carboxy-containing polymerizable unsaturated monomer (M-1).

When water-dispersible acrylic resin particles having a core/shell structure are used, starting monomers for the core component of core/shell emulsion preferably include an alkyl (meth)acrylate monomer whose alkyl moiety has 3 or 4 carbons. In this case, the content of alkyl (meth)acrylate monomer whose alkyl moiety has 3 or 4 carbons is preferably 60 mass % or more, relative to the total amount of monomer mixture as the starting material for the core component.

Further, in a preferable embodiment, starting monomers for the core component of core/shell emulsion may include the polyvinyl compound (M-4). In this case, the content of the polyvinyl compound (M-4) is preferably 4 mass % or less, more preferably 1 to 3 mass %, relative to the total amount of monomer mixture as the starting material for the core component.

A monomer containing an N atom-containing group can be preferably used as one of the starting monomers for the shell component of core/shell emulsion. Examples of such N atom-containing groups include urea groups, amide groups, etc.

Any monomer may be used as a monomer containing an N atom-containing group insofar as the monomer is a polymerizable unsaturated monomer having at least one group containing an N atom. In particular, a urea group-containing polymerizable unsaturated monomer can be suitably used.

A urea group-containing polymerizable unsaturated monomer (S-1) is a polymerizable unsaturated monomer having a urea group (urea bonding group (—NH—CO—NH—)).

The urea group (urea bonding group) forms a pseudo cross-linked structure through hydrogen bonding in a coating film after a solvent such as water has been vaporized, and can produce the effect of increasing the viscosity of the coating film.

Further, in the case of a urethane group (—NHCO—) and an amide group, a nitrogen atom has one hydrogen atom bonded thereto. In contrast, in the case of a urea group, a nitrogen atom has two hydrogen atoms bonded thereto, i.e., there are more hydrogen bonding sites. Accordingly, a pseudo cross-linked structure formed by a urea group through hydrogen bonding is denser than that formed by a urethane group or an amide group, and a urea group can thus produce a high effect of increasing the viscosity.

Although any polymerizable unsaturated monomer may be used insofar as it contains a urea group, examples of the urea group-containing polymerizable unsaturated monomer (S-1) include monomers obtained by reacting an isocyanate group-containing polymerizable unsaturated monomer with an amine compound.

Examples of the isocyanate group-containing polymerizable unsaturated monomers include 2-methacryloyloxyethyl isocyanate, 2-acryloyloxyethyl isocyanate, m-isopropenyl-α,α-dimethylbenzyl isocyanate, etc.; adducts of hydroxy-containing polymerizable unsaturated monomers with diisocyanates; etc.

Examples of the hydroxy-containing polymerizable unsaturated monomers include glycol (meth)acrylates such as 2-hydroxyethyl (meth)acrylate, 2-hydroxypropyl (meth) acrylate, 2-hydroxybutyl (meth)acrylate, and 4-hydroxybutyl (meth)acrylate; allyl alcohols; monoallyl ethers of polyhydric alcohols; etc.

Examples of the diisocyanate include alicyclic, aromatic group-containing aliphatic, or aromatic diisocyanate compounds. Further, isocyanurates of diisocyanate compounds (diisocyanate trimers) may also be used.

Examples of diisocyanate compounds include trimethylene diisocyanate, tetramethylene diisocyanate, hexamethylene diisocyanate, 2,2,4-trimethylhexane diisocyanate, undecane diisocyanate-(1,11), lysine ester diisocyanate, cyclohexane 1,3- and 1,4-diisocyanate, 1-isocyanato-3-isocyanatomethyl-3,5,5-trimethylcyclohexane (IPDI), 4,4'-diisocyanato dicyclodicyclomethane, ω,ω'-dipropylether diisocyanate, thiodipropyl diisocyanate, cyclohexyl-1,4-diisocyanate, dicyclohexylmethane-4,4'-diisocyanate, 1,5-dimethyl-2,4-bis(isocyanatomethyl)benzene, 1,5-trimethyl-2,4-bis(ω-isocyanatoethyl)-benzene, 1,3,5-trimethyl-2,4-bis (isocyanatomethyl)-benzene, 1,3,5-triethyl-2,4-bis (isocyanatomethyl)benzene, dicyclohexyl dimethylmethane-4,4'-diisocyanate, 2,4-toluene diisocyanate, 2,6-toluene diisocyanate and diphenylmethane-4,4'-diisocyanate, etc.

Further, 2,4-diisocyanatotoluene and/or 2,6-diisocyanatotoluene, 4,4'-diisocyanatodiphenylmethane and aromatic diisocyanates such as 1,4-diisocyanatoisopropylbenzene, cyclohexyl-1,4-diisocyanate, toluene diisocyanate, and hexamethylene diisocyanate may also be used. Further, mixtures of these compounds may also be used.

Examples of isocyanurates of the diisocyanate compounds include the above-mentioned diisocyanate trimers. Mixtures of diisocyanates or trimers may also be used as the isocyanates.

Examples of amine compounds for producing urea groups by reacting with an isocyanate group-containing polymerizable unsaturated monomer include primary and secondary amines. Of these, primary amines may be suitably used.

An amine having one or more primary amine group and one or more ether and/or hydroxy group may also be used as the primary amine. Examples thereof include ethanolamine, 6-aminohexanol, p-methoxybenzylamine, methoxypropylamine, 3,4-dimethoxyphenyl ethylamine, 2,5-dimethoxyaniline, furfurylamine, tetrahydrofurfurylamine, benzylamine, ethylamine, propylamine (n-propylamine, isopropylamine), butylamine (n-butylamine, sec-butylamine, tert-butylamine), n-pentylamine, 1-methylbutylamine, 1-ethylpropylamine, 2-ethylbutylamine, hexylamine, octylamine, decylamine, stearylamine, cyclohexylamine, aniline, hexamethylenediamine and like primary amines. These amine compounds may be used in combination.

Ethylamine, propylamine, and butylamine are preferable as the amine compounds, in view of improving the water resistance.

The isocyanate group-containing polymerizable unsaturated monomer and the amine compound are reacted by a known method in such a manner that the equivalent ratio (active hydrogen present in the amine compound/isocyanate group) of active hydrogens present in the amine compound is 0.5-2, preferably 0.7-1.5, more preferably 0.8-1.2, relative to isocyanate groups present in the isocyanate group-containing polymerizable unsaturated monomer.

In particular, in the reaction between the isocyanate group-containing polymerizable unsaturated monomer and the amine compound, one of the isocyanate group-containing polymerizable unsaturated monomer and the amine compound may generally be used in an amount greater than the stoichiometric amount. For example, the ratio of the number of amino groups in the amine compound may be 0.7-1.5, preferably 0.9-1.1, relative to the number of isocyanate groups in the isocyanate group-containing polymerizable unsaturated monomer.

The isocyanate group-containing polymerizable unsaturated monomer may be reacted with the amine compound by a known method by mixing them together and, if desired, increasing the temperature. The reaction is desirably carried out at a temperature of 10° C. to 70° C., preferably 20° C. to 50° C. Generally, reaction components can be mixed by a known method. It is typically preferable to add an isocyanate group-containing polymerizable unsaturated monomer to an amine compound. This addition can be carried out in multiple stages, if desired. Generally, the reaction can be carried out in the presence of acetone, methyl isobutyl ketone, benzene, toluene, xylene, tetrahydrofuran, or an aliphatic hydrocarbon such as petroleum ether.

The amount of the urea group-containing polymerizable unsaturated monomer (S-1) used in the starting monomers for the shell component of core/shell emulsion is 5 to 70 mass %, particularly 10 to 60 mass %, further particularly 15 to 50 mass %, still further particularly 15 to 40 mass %, based on the total amount of the urea group-containing polymerizable unsaturated monomer (S-1) and urea group-free polymerizable unsaturated monomers, in view of smoothness and distinctness of image of the resulting coating film.

Although the ratio of starting monomers for the core component to starting monomers for the shell component is not particularly limited, the mass ratio of the former to the latter may usually be 70/30-90/10, preferably 75/25-85/15.

The water-dispersible acrylic resin particle may have a hydroxy value of 0 to 150 mg KOH/g, preferably 5 to 100 mg KOH/g, more preferably 10 to 50 mg KOH/g, in view of water resistance and curability of the resulting coating film, etc.

Further, the water-dispersible acrylic resin particle may have an acid value of 0 to 100 mg KOH/g, preferably 0 to 50 mg KOH/g, more preferably 0 to 35 mg KOH/g, in view of storage stability, water resistance of the resulting coating film, etc.

Additionally, the water-dispersible acrylic resin particle may have an average particle size of 10 to 500 nm, preferably 20 to 300 nm, more preferably 40 to 200 nm, in view of dispersion stability of the particles and smoothness of the resulting coating film.

In this specification, the average particle size of the water-dispersible acrylic resin particles refers to a value obtained by measurement at 20° C. using a submicron particle size distribution analyzer after dilution with deionized water according to a usual method. For example, "COULTER N4" (trade name of Beckman Coulter, Inc.) may be used as the submicron particle size distribution analyzer.

The water-dispersible acrylic resin particle is preferably neutralized with a basic compound.

Ammonia or water-soluble amino compound may be used as a neutralizing agent for the water-dispersible acrylic resin particle. Suitable examples thereof include monoethanolamine, ethylamine, dimethylamine, diethylamine, triethylamine, propylamine, dipropylamine, isopropylamine, diisopropylamine, triethanolamine, butylamine, dibutylamine, 2-ethylhexylamine, ethylenediamine, propylenediamine, methylethanolamine, dimethylethanolamine, diethylethanolamine, 2-amino-2-methyl propanol, diethanolamine, morpholine, etc.

Curing Agent (B)

Usable examples of the curing agent (B) for the aqueous first colored coating composition (X) of the present invention include a melamine resin (b-1), a polyisocyanate compound (b-2), a blocked polyisocyanate compound (b-3), and a carbodiimide group-containing compound (b-4).

Of these, the melamine resin (b-1) can be suitably used.

The curing agent (B) is suitably used in an amount of 1 to 50 mass %, preferably 3 to 30 mass %, more preferably 5 to 20 mass %, per 100 parts by mass of the resin solids content in the aqueous first colored coating composition (X).

When the curing agent (B) is a melamine resin, the acrylic resin (A) usually contains a hydroxy group; and particularly suitably, the acrylic resin (A) has a hydroxy value of 1 to 200 mg KOH/g, preferably 3 to 100 mg KOH/g, more preferably 5 to 80 mg KOH/g.

Examples of the melamine resin (b-1) include dimethylolmelamine, trimethylolmelamine, tetramethylolmelamine, pentamethylolmelamine, hexamethylolmelamine and like methylolmelamines; alkyl-etherified products of methylolmelamines with alcohols; etherified products of methylolmelamine condensates with alcohols; etc. Examples of alcohols used herein include methyl alcohol, ethyl alcohol, propyl alcohol, isopropyl alcohol, butyl alcohol, isobutyl alcohol, 2-ethylhexyl alcohol, etc.

Commercial products are available as melamine resins. Examples of trade names of such commercial products include "Cymel 303", "Cymel 323", "Cymel 325", "Cymel 327", "Cymel 350", "Cymel 370", "Cymel 380", "Cymel 385", "Cymel 212", "Cymel 253", "Cymel 254" (Cytec Industries Inc.); "Resimin 735", "Resimin 740", "Resimin 741", "Resimin 745", "Resimin 746", "Resimin 747" (Monsanto Co., Ltd.); "Sumimal M55", "Sumimal M30W", "Sumimal M50W" (Sumitomo Chemical Co., Ltd.); "U-VAN 20SE", "U-VAN 28SE" (Mitsui Chemicals, Inc.); etc.

Usable melamine resins include methyl-etherified melamine resins obtained by etherifying some or all of the methylol groups in partially or fully methylolated melamine resins with methyl alcohol; butyl-etherified melamine resins obtained by etherifying some or all of the methylol groups in partially or fully methylolated melamine resins with butyl alcohol; and methyl-butyl-etherified melamine resins obtained by etherifying some or all of the methylol groups in partially or fully methylolated melamine resins with methyl alcohol and butyl alcohol.

Of these, methyl-etherified melamine resins can be preferably used in view of anti-solvent swelling property, and imino group-containing methyl-etherified melamine resins can be preferably used in view of chipping resistance.

Further, when a melamine resin is used as a curing agent, usable examples of curing catalysts include sulfonic acids such as p-toluenesulfonic acid, dodecylbenzenesulfonic acid, and dinonylnaphthalene sulfonic acid; salts obtained by neutralizing such sulfonic acids with amines; salts obtained by neutralizing phosphoric ester compounds with amines; etc.

When the curing agent (B) is the polyisocyanate compound (b-2), the acrylic resin (A) usually contains a hydroxy group; and particularly suitably, the acrylic resin (A) has a hydroxy value of 100 to 200 mg KOH/g, preferably 130 to 180 mg KOH/g, more preferably 140 to 170 mg KOH/g. Further, suitably, the equivalent ratio (NCO/OH) of isocyanate groups in the isocyanate group-containing compound (b-2) is 0.5 to 2.0, more preferably 0.8 to 1.5, relative to hydroxy groups in the acrylic resin (A).

The polyisocyanate compound (b-2) is a compound having at least two isocyanate groups per molecule. Examples thereof include aliphatic polyisocyanates, alicyclic polyisocyanates, aliphatic-aromatic polyisocyanates, aromatic polyisocyanates, derivatives of these polyisocyanates, etc.

Examples of the aliphatic polyisocyanates include aliphatic diisocyanates such as trimethylene diisocyanate, tetramethylene diisocyanate, hexamethylene diisocyanate, pentamethylene diisocyanate, 1,2-propylene diisocyanate, 1,2-butylene diisocyanate, 2,3-butylene diisocyanate, 1,3-butylene diisocyanate, 2,4,4- or 2,2,4-trimethylhexamethylene diisocyanate, 2,6-diisocyanatomethylcaproate; aliphatic triisocyanates such as lysine ester triisocyanates, 1,4,8-triisocyanato octane, 1,6,11-triisocyanato undecane, 1,8-diisocyanato-4-isocyanato methyloctane, 1,3,6-triisocyanato hexane, 2,5,7-trimethyl-1,8-diisocyanato -5-isocyanato methyloctane; etc.

Examples of the alicyclic polyisocyanates include 1,3-cyclopentene diisocyanate, 1,4-cyclohexane diisocyanate, 1,3-cyclohexane diisocyanate, 3-isocyanatomethyl-3,5,5-trimethylcyclohexyl isocyanate (trivial name: isophorone diisocyanate), methyl-2,4-cyclohexane diisocyanate, methyl-2,6-cyclohexane diisocyanate, 1,3- or 1,4-bis(isocyanatomethyl)cyclohexane (common name: hydrogenated xylenediisocyanate) or a mixture thereof, norbornane diisocyanate and like alicyclic diisocyanates; 1,3,5-triisocyanato cyclohexane, 1,3,5-trimethylisocyanato cyclohexane, 2-(3-isocyanatopropyl)-2,5-di(isocyanatomethyl)-bicyclo[2.2.1]heptane, 2-(3-isocyanatopropyl)-2,6-di(isocyanatomethyl)-bicyclo[2.2.1]heptane, 3-(3-isocyanatopropyl)-2,5-di(isocyanatomethyl)-bicyclo[2.2.1]heptane, 5-(2-isocyanatoethyl)-2-isocyanatomethyl-3-(3-isocyanatopropyl)-bicyclo[2.2.1]heptane, 6-(2-isocyanatoethyl)-2-isocyanatomethyl-3-(3-isocyanatopropyl)-bicyclo[2.2.1]heptane, 5-(2-isocyanatoethyl)-2-isocyanatomethyl-2-(3-isocyanatopropyl)-bicyclo[2.2.1]heptane, 6-(2-isocyanatoethyl)-2-isocyanatemethyl-2-(3-isocyanatopropyl)-bicyclo[2.2.1]heptane and like alicyclic triisocyanates; etc.

Examples of the aliphatic-aromatic polyisocyanates include aliphatic-aromatic diisocyanates such as 1,3- or 1,4-xylylene diisocyanate or a mixture thereof, ω,ω'-diisocyanato 1,4-diethylbenzene, and 1,3- or 1,4-bis(1-isocyanato 1-methylethyl)benzene (common name: tetramethylxylylene diisocyanate) or a mixture thereof; aliphatic-aromatic triisocyanates such as 1,3,5-triisocyanatomethylbenzene; etc.

Examples of the aromatic polyisocyanates include aromatic diisocyanates such as m-phenylene diisocyanate, p-phenylene diisocyanate, 4,4'-diphenyl diisocyanate, 1,5-naphthalene diisocyanate, 2,4'- or 4,4'-diphenylmethane diisocyanate or a mixture thereof, 2,4- or 2,6-tolylene diisocyanate or a mixture thereof, and 4,4'-toluidine diisocyanate, 4,4'-diphenylether diisocyanate; aromatic triisocyanates such as triphenylmethane-4,4',4"-triisocyanate, 1,3,5-triisocyanato benzene, and 2,4,6-triisocyanato toluene; aromatic tetraisocyanates such as 4,4'-diphenylmethane-2,2',5,5'-tetraisocyanate; etc.

Examples of the polyisocyanate derivatives include dimers, trimers, biurets, allophonates, urethodiones, urethoimines, isocyanurates, oxadiazinetriones, polymethylene polyphenyl polyisocyanates (crude MDI, polymeric MDI), and crude TDI of the polyisocyanate compounds described above.

The polyisocyanates and derivatives thereof may be used singly, or in a combination of two or more. Further, of these polyisocyanates, aliphatic diisocyanates, alicyclic diisocyanates, and derivatives thereof may be suitably used singly, or in a combination of two or more.

As the polyisocyanate compound (b-2) of the present invention, a hydrophilic polyisocyanate compound (b-2') obtained by modifying the polyisocyanate compound to have a hydrophilic property is particularly preferable, in view of the smoothness of the resulting coating film.

Examples of the hydrophilic polyisocyanate compound (b-2') include anionic hydrophilic polyisocyanate compounds (b-2'-1); nonionic hydrophilic polyisocyanate compounds (b-2'-2); etc. The anionic hydrophilic polyisocyanate compound (b-2'-1) is obtained from an active-hydrogen-group-containing compound having an anionic group by reacting the active hydrogen group with the isocyanate group in the polyisocyanate compound. The nonionic hydrophilic polyisocyanate compounds (b-2'-2) are obtained by reacting hydrophilic polyether alcohol such as mono-alcohol of polyoxyethylene with the polyisocyanate compound.

The active-hydrogen-group-containing compound having anionic groups such as carboxy groups, sulfonic acid groups, phosphate groups, betaine-structure-containing groups such as sulfobetaine, and also active hydrogen groups such as hydroxy groups and amino groups reactive to isocyanate groups. By reacting the compound and a polyisocyanate compound, the polyisocyanate compound becomes hydrophilic.

Examples of the active-hydrogen-group-containing compounds having an anionic group include, but are not limited to, a compound having one anionic group and two or more active hydrogen groups. More specific examples of active-hydrogen-group-containing compounds having a carboxy group include dihydroxy carboxylic acids such as 2,2-dimethylolacetic acid, 2,2-dimethylollactic acid, 2,2-dimethylol propionic acid, 2,2-dimethylol butanoic acid, dimethylolheptanoic acid, dimethylolnonanoic acid, 2,2-dimethylol butyric acid, and 2,2-dimethylol valeric acid; diaminocarboxylic acids such as 1-carboxy-1,5-pentylenediamine, dihydroxybenzoic acid, 3,5-diaminobenzoic acid, lysine, and arginine; half-ester compounds of polyoxypropylene triol with maleic anhydride, phthalic anhydride, or the like; etc.

Examples of the activity hydroxy-containing compounds having a sulfonic acid group include N,N-bis(2-hydroxyethyl)-2-aminoethane sulfonic acid, 1,3-phenylenediamine-4,6-disulfonic acid, diaminobutane sulfonic acid, 3,6-diamino-2-toluene sulfonic acid, 2,4-diamino-5-toluene sulfonic acid, 2-(cyclohexyl amino)-ethane sulfonic acid, 3-(cyclohexyl amino)-propane sulfonic acid, etc.

Examples of the active-hydrogen-group-containing compounds having a phosphate group include 2,3-dihydroxy propyl phenylphosphate, etc.

Examples of the active-hydrogen-group-containing compounds having a betaine-structure-containing group include sulfobetaine-group-containing compounds obtained by, for example, reacting tertiary amines such as N-methyl diethanolamine, with 1,3-propane sultone.

Further, these active-hydrogen-group-containing compounds having an anionic group may be modified into an alkylene oxide modified product by adding an alkylene oxide such as ethylene oxide or propylene oxide thereto.

These active-hydrogen-group-containing compounds having an anionic group may be used solely or in a combination of two or more.

Both nonionic and anionic emulsifiers may be used as the emulsifiers for imparting water-dispersibility to the polyisocyanate compounds. Polyethylene oxides may be suitably used as nonionic groups, and sulfate or phosphate salts may be suitably used as anionic groups. They may be used in combination.

The same polyisocyanate compounds as those mentioned above may be used herein. Particularly preferable examples include hexamethylene diisocyanate (HMDI), isophorone diisocyanate (IPDI), and derivatives thereof.

The above-described aliphatic polyisocyanates, alicyclic polyisocyanates, aromatic aliphatic polyisocyanates, aromatic polyisocyanates, and blocked derivatives thereof may be used as the blocked polyisocyanate compounds (b-3).

Examples of the derivatives include isocyanurates, biurets, adducts (e.g., TMP (trimethylolpropane) adducts), etc.

The blocking agent blocks free isocyanate group. When a blocked polyisocyanate compound is heated at, for example, a temperature of 100° C. or higher, and preferably 130° C. or higher, isocyanate groups are regenerated and can readily react with hydroxy groups. Examples of such blocking agents include phenol, cresol, xylenol, nitrophenol, ethylphenol, hydroxydiphenyl, butylphenol, isopropylphenol, nonylphenol, octylphenol, methyl hydroxybenzoate and like phenol compounds; ε-caprolactam, δ-valerolactam, γ-butyrolactam, β-propiolactam and like lactam compounds; methanol, ethanol, propyl alcohol, butyl alcohol, amyl alcohol, lauryl alcohol and like aliphatic alcohol compounds; ethylene glycol monomethyl ether, ethylene glycol monoethyl ether, ethylene glycol monobutyl ether, diethylene glycol monomethyl ether, diethylene glycol monoethyl ether, propylene glycol monomethyl ether, methoxymethanol and like ether compounds; benzyl alcohol; glycolic acid; methyl glycolate, ethyl glycolate, butyl glycolate and like glycolates; lactic acid, methyl lactate, ethyl lactate, butyl lactate and like lactates; methylol urea, methylol melamine, diacetone alcohol, 2-hydroxyethyl acrylate, 2-hydroxyethyl methacrylate and like alcohol compounds; formamide oxime, acetamide oxime, acetoxime, methyl ethyl ketoxime, diacetyl monoxime, benzophenone oxime, cyclohexane oxime and like oxime compounds; dimethyl malonate, diethyl malonate, ethyl acetoacetate, methyl acetoacetate, acetylacetone and like active methylene compounds; butyl mercaptan, tert-butyl mercaptan, hexyl mercaptan, tert-dodecyl mercaptan, 2-mercaptobenzothiazole, thiophenol, methylthiophenol, ethylthiophenol and like mercaptan compounds; acetanilide, acetanisidide, acetotoluide, acrylamide, methacrylamide, acetamide, stearamide, benzamide and like acid amide compounds; succinimide, phthalimide, maleimide and like imide compounds; diphenylamine, phenylnaphthylamine, xylidine, N-phenylxylidine, carbazole, aniline, naphthylamine, butylamine, dibutylamine, butylphenylamine and like amines; imidazole, 2-ethylimidazole and like imidazole compounds; 3,5-dimethylpyrazole and like pyrazole compounds; urea, thiourea, ethylene urea, ethylenethiourea, diphenylurea and like urea compounds; phenyl N-phenylcarbamate and like carbamate compounds; ethyleneimine, propyleneimine and like imine compounds; sodium bisulfite, potassium bisulfite and like sulfite compounds; etc.

Further, a hydroxy carboxylic acid having one or more hydroxy groups and one or more carboxy groups per molecule may be used as a part of the blocking agent. Examples of hydroxy carboxylic acids include hydroxy pivalic acid, dimethylol propionic acid, etc. The mono-blocked isocyanate compound blocked by the hydroxy carboxylic acid has a carboxy group derived from a hydroxy carboxylic acid. Such a compound is preferable because it has good water dispersibility based on the hydrophilicity of the carboxy group.

Further, a blocking agent to which a nonionic hydrophilic group is introduced and water dispersibility is imparted by the use of a polyethylene glycol having a hydroxy group in one end and a methoxy group in the other end as a part of the blocking agent may also be effectively used. Usable examples of commercial products include "Desmodule PL3470", "Desmodule PL3475", "Desmodule VPLS2253/1" (trade names; Sumika Bayer Urethane Co., Ltd.), etc.

When the blocked polyisocyanate compound (b-3) is used as a curing agent, an organic tin compound may be used as a curing catalyst.

The carbodiimide group-containing compound (b-4) can be obtained, for example, by subjecting isocyanate groups in a polyisocyanate compound to a carbon dioxide removal reaction. Examples of commercial products usable as such carbodiimide group-containing compounds include "Carbodilite V-02", "Carbodilite V-02-L2", "Carbodilite V-04", "Carbodilite E-01", and "Carbodilite E-02" (trade names, Nisshinbo Industries, Inc.), etc.

When the carbodiimide group-containing compound (b-4) is used as the curing agent (B), the acrylic resin (A) usually contains a carboxy group; and particularly suitably, the acrylic resin (A) has an acid value based on the carboxy group of 5 to 80 mg KOH/g, preferably 10 to 70 mg KOH/g, more preferably 30 to 70 mg KOH/g.

Urethane Resin Emulsion (C)

Examples of the urethane resin emulsion (C) used in the aqueous first colored coating composition (X) of the present invention include urethane resin emulsion prepared from a polyisocyanate component (c1) and a polyol component (c2) according to a usual method.

Examples of the polyisocyanate component (c1) include diisocyanates and other polyisocyanates.

Diisocyanates used as starting materials for the urethane resin emulsion (C) are not particularly limited, and diisocyanates widely known in the relevant technical field may be used singly, or in a combination or two or more. Examples of the diisocyanates include tolylene diisocyanate, diphenylmethane-4,4'-diisocyanate, p-phenylene diisocyanate, xylylene diisocyanate, 1,5-naphthylene diisocyanate, 3,3'-dimethyl diphenyl-4,4'-diisocyanate, dianisidine diisocyanate, tetramethylxylylene diisocyanate and like aromatic diisocyanates; isophorone diisocyanate, dicyclohexylmethane-4,4'-diisocyanate, trans-1,4-cyclohexyl diisocyanate, norbornene diisocyanate and like alicyclic diisocyanates; and 1,6-hexamethylene diisocyanate, 2,2,4 and/or (2,4,4)-trimethyl hexamethylene diisocyanate, lysine diisocyanate and like aliphatic diisocyanates. As the diisocyanates, alicyclic diisocyanates are preferable in view of improving anti-organic solvent swelling property of the resulting coating film, with isophorone diisocyanate and dicyclohexylmethane-4,4'-diisocyanate being particularly preferable.

In a preferable embodiment, the above diisocyanates may be used in a form of blocked isocyanates, i.e., isocyanates blocked with various blocking agents. Further, the content (mass %) of diisocyanate in the polyisocyanate component (c1) is preferably 10 to 60%, more preferably 20 to 40%, in view of chipping resistance.

Other polyisocyanates used as starting materials for the urethane resin emulsion (C) are polyisocyanates having three or more isocyanate groups per molecule. Examples thereof include isocyanurate trimers and biuret trimers of the above-mentioned diisocyanate, trimethylolpropane adducts, etc.; triphenylmethane triisocyanate, 1-methylbenzole-2,4,6-triisocyanate, dimethyl triphenylmethane tetraisocyanate and like tri- or poly-functional isocyanates, etc. These isocyanate compounds may be used in the form of modified products such as carbodiimide-modified products, isocyanurate-modified products, and biuret-modified products, or in the form of blocked isocyanates, i.e., isocyanates blocked with various blocking agents.

The polyol component (c2) is not particularly limited; polyols widely known in the relevant technical field may be used singly, or in a combination of two or more. Examples of the polyols include polycarbonate polyols, ester bond-containing polyols, polycaprolactone polyols, low-molecular-weight polyols, polyether polyols, polybutadiene polyols, silicone polyols, carboxy-containing diols, etc. Polycarbonate polyols, ester bond-containing polyols, polycaprolactone polyols, and carboxy-containing diols are preferable, and polycarbonate polyols and carboxy-containing diols are more preferable.

The polycarbonate polyols are compounds usually obtained by a polycondensation reaction of a known polyol with a carbonylating agent.

Examples of polyol components include polyhydric alcohols such as diols, and trihydric or higher polyhydric alcohols.

Examples of diols as starting materials for polycarbonate polyols include 1,3-propanediol, 1,4-butanediol, 1,5-pentanediol, 1,6-hexanediol, 1,7-heptanediol, 1,8-octanediol, 1,9-nonanediol, 1,10-decanediol and like straight-chain aliphatic diols; 2-methyl-1,3-propanediol, 3-methyl-1,5-pentanediol, neopentyl glycol, 2-ethyl-1,6-hexanediol, 2,2-diethyl-1,3-propanediol, 2-butyl-2-ethyl-1,3-propanediol, 2-methyl-1,8-octanediol, 2,2,4-trimethyl-1,3-pentanediol, 2-ethyl-1,3-hexanediol and like branched-chain aliphatic diols; 1,3-cyclohexane diol, 1,4-cyclohexane diol, 1,4-cyclohexane dimethanol and like alicyclic diols; p-xylenediol, p-tetrachloroxylenediol and like aromatic diols; diethylene glycol, dipropylene glycol and like ether diols; etc. Of these diols, cyclohexane dimethanol is preferable. These diols may be used singly, or in a combination of two or more.

Examples of trihydric or higher polyhydric alcohols as starting materials for polycarbonate polyols include glycerin, trimethylolethane, trimethylolpropane, trimethyloipropane dimer, pentaerythritol, etc.

Known carbonylating agents may be used as the carbonylating agents used as starting materials for polycarbonate polyols. Specific examples thereof include alkylene carbonates, dialkyl carbonates, diaryl carbonates, phosgene, etc. They may be used singly, or in combination. Of these, preferable examples include ethylene carbonate, propylene carbonate, dimethyl carbonate, diethyl carbonate, dibutyl carbonate, diphenyl carbonate, etc.

Of the polyol components (c2), examples of ester bond-containing polyols include polyester polyols, polyester polycarbonate polyols, etc.

Examples of the polyester polyols include a polyester polyol obtained by direct esterification reaction and/or ester exchange reaction of a polyhydric alcohol with a polycarboxylic acid or its ester-forming compound thereof (e.g., ester, anhydride, halide) whose amount is less than the stoichiometric amount of the polyhydric alcohol.

Examples of polyhydric alcohols as starting materials for the polyester polyols include ethylene glycol, 1,2-propanediol, 1,3-propanediol, 2-methyl-1,3-propanediol, 2-butyl-2-ethyl-1,3-propanediol, 1,4-butanediol, neopentyl glycol, 3-methyl-2,4-pentanediol, 2,4-pentanediol, 1,5-pentanediol, 3-methyl-1,5-pentanediol, 2-methyl-2,4-pentanediol, 2,4-diethyl-1,5-pentanediol, 1,6-hexanediol, 1,7-heptanediol, 3,5-heptanediol, 1,8-octanediol, 2-methyl-1,8-octanediol, 1,9-nonanediol, 1,10-decanediol, diethylene glycol, triethylene glycol and like aliphatic diols; cyclohexane dimethanol, cyclohexane diol and like alicyclic diols; trimethylolethane, trimethylolpropane, hexitols, pentitols, glycerin, pentaerythritol, tetramethylolpropane and like trihydric or higher polyhydric alcohols.

Examples of polycarboxylic acids or ester-forming compounds thereof as starting materials for the polyester polyols include oxalic acid, malonic acid, succinic acid, glutaric acid, adipic acid, pimelic acid, suberic acid, azelaic acid, sebacic acid, dodecanedioic acid, 2-methylsuccinic acid, 2-methyladipic acid, 3-methyladipic acid, 3-methylpentanedioic acid, 2-methyloctanedioic acid, 3,8-dimethyldecanedioic acid, 3,7-dimethyldecanedioic acid, hydrogenated dimer acid, dimer acid and like aliphatic dicarboxylic acids; phthalic acid, terephthalic acid, isophthalic acid, naphthalene dicarboxylic acid and like aromatic dicarboxylic acids; 1,2-cyclopentane dicarboxylic acid, 1,3-cyclopentane dicarboxylic acid, 1,2-cyclohexane dicarboxylic acid, 1,3-cyclohexane dicarboxylic acid, 1,4-cyclohexane dicarboxylic acid, 1,4-dicarboxymethylcyclohexane, nadic acid, methylnadic acid and like alicyclic dicarboxylic acids; tricarboxylic acids (e.g., trimellitic acid, trimesic acid, trimer of castor oil fatty acid, etc.) and like polycarboxylic acids; acid anhydrides of these polycarboxylic acids; halides such as chlorides and bromides of the polycarboxylic acids; lower esters of the polycarboxylic acids such as methyl esters, ethyl esters, propyl esters, isopropyl esters, butyl esters, isobutyl esters, and amyl esters; and γ-caprolactone, δ-caprolactone, ϵ-caprolactone, dimethyl-ϵ-caprolactone, δ-valerolactone, γ-valerolactone, γ-butyrolactone and like lactones.

Of the polyol components (c2), examples of polycaprolactone polyols include ring-opened polymers of caprolactones such as polycaprolactone diols.

Of the polyol components (c2), examples of low-molecular-weight polyols include polyhydric alcohols exemplified as the polyhydric alcohols used as starting materials for polyester polyol, which is one of the polyol components (c2).

Of the polyol components (c2), examples of the polyether polyols include ethylene oxide and/or propylene oxide adducts of the low-molecular-weight polyols, polytetramethylene glycols, etc.

Of the polyol components (c2), polybutadiene polyols widely known in the relevant technical field may be used as the polybutadiene polyols.

Of the polyol components (c2), examples of the silicone polyols include hydroxy-terminated silicone oils having a siloxane bond in a molecule, and the like.

A carboxy-containing diol may be used as the polyol component (C2). The carboxy-containing diol is used for introducing a hydrophilic group to the polyurethane molecules. The hydrophilic group is a carboxy group. Specific examples thereof include dimethylol propionic acid, dimethylol butanoic acid, dimethylol butyric acid, and dimethylol valeric acid.

Of the polyol components, a preferable example is a hydrophobic diol in which a compound or compounds having a hydrocarbon group having 6 or more carbons account for 50 mass % or more, preferably 60 to 100 mass %, further preferably 80 to 100 mass % of the starting compounds of the diol, in view of improving anti-organic solvent swelling property of the resulting coating film. Polycarbonate diols, polyester diols, etc. are preferable as such hydrophobic diols.

When the hydrophobic diol is a polycarbonate diol, a diol and a carbonylating agent are starting compounds.

When the hydrophobic diol is a polyester diol, a diol and a polycarboxylic acid or an ester-forming compound thereof are starting compounds.

Usable examples of diols as starting compounds for the hydrophobic diol include those exemplified as the diols used as starting materials for polycarbonate polyol, which is one of the polyol components (c2).

Of these diols, examples of compounds having a hydrocarbon group having 6 or more carbons include 1,6-hexanediol, 1,7-heptanediol, 1,8-octanediol, 1,9-nonanediol and 1,10-decanediol, 3-methyl-1,5-pentanediol, 2-ethyl-1,6-hexanediol, 2,2-diethyl-1,3-propanediol, 2-butyl-2-ethyl-1,3-propanediol, 2-methyl-1,8-octanediol, 2,2,4-trimethyl-1,3-pentanediol, 2-ethyl-1,3-hexanediol, 1,3-cyclohexane diol, 1,4-cyclohexane diol, 1,4-cyclohexane dimethanol, p-xylenediol, p-tetrachloroxylenediol, etc.

Of the diols that have a hydrocarbon group having 6 or more carbons, 1,6-hexanediol, 1,4-cyclohexane dimethanol, etc. can be particularly preferably used in view of chipping resistance.

Further, those exemplified as polycarboxylic acids or ester-forming compounds thereof used as starting materials for polyester polyol, which is one of the polyol components (c2), may be used as the polycarboxylic acids or ester-forming compounds thereof used as starting compounds for the hydrophobic diol.

Of these polycarboxylic acids or ester-forming compounds thereof, examples of compounds that have a hydrocarbon group having 6 or more carbons include azelaic acid, sebacic acid, dodecanedioic acid, 3-methylpentanedioic acid, 2-methyloctanedioic acid, 3,8-dimethyldecanedioic acid, 3,7-dimethyldecanedioic acid, phthalic acid, terephthalic acid, isophthalic acid, naphthalene dicarboxylic acid, 1,2-cyclohexane dicarboxylic acid, 1,3-cyclohexane dicarboxylic acid, 1,4-cyclohexane dicarboxylic acid, trimellitic acid, acid anhydrides thereof, ϵ-caprolactone, dimethyl-c-caprolactone, etc.

These polyol components (c2) may be used singly, or in a combination of two or more.

Of the polyol components (c2), the amount of the hydrophobic diol used is preferably 20 to 100 mass %, more preferably 50 to 100 mass %, in view of the water swelling rate and organic solvent swelling rate.

In the present invention, the amount of the polyisocyanate component (c1) and the polyol component (c2) is not particularly limited insofar as the water swelling rate and the organic solvent swelling rate of the first colored coating film formed from the ultimately resulting aqueous first colored coating composition (X) are within the above-described ranges. In a preferable embodiment, the polyol component (c2) is preferably used in an amount of 40 to 90 mass %, more preferably 50 to 80 mass %, relative to the total mass of the polyisocyanate component (c1) and the polyol component (c2) used for the preparation of the urethane resin emulsion (C).

In addition to the polyisocyanate component (c1) and the polyol component (c2), an amine component (c3) may be used, if necessary, as a starting material for forming a urea bond, increasing the molecular weight, and the like. Examples of the amine components (c3) include monoamine compounds and diamine compounds.

Any monoamine compound may be used with no limitation; monoamine compounds widely known in the relevant technical field may be used singly, or in a combination or two or more. Examples of the monoamine compounds include ethylamine, propylamine, 2-propylamine, butylamine, 2-butylamine, tertiary butylamine, isobutylamine and like alkylamines; aniline, methylaniline, phenylnaphthylamine, naphtylamine and like aromatic amines; cyclohexaneamine, methylcyclohexanamine and like alicyclic amines; 2-methoxy ethylamine, 3-methoxy propylamine, 2-(2-methoxy ethoxy)ethylamine and like ether amines; ethanolamine, propanolamine, butylethanolamine, 1-amino-2-methyl-2-propanol, 2-amino-2-methylpropanol, diethanolamine, diisopropanolamine, dimethylaminopropylethanolamine, dipropanolamine, N-methylethanolamine, N-ethyl ethanolamine and like alkanolamines; etc. Of these, alkanolamines are preferable because they impart good water dispersion stability to the polyurethane molecules. 2-aminoethanol and diethanolamine are more preferable because they are low cost.

Any diamine compound may be used with no limitation; diamine compounds widely known in the relevant technical field may be used singly, or in a combination or two or more. Examples of the diamine compounds include low-molecular-weight diamines (e.g., ethylenediamine, propylenediamine, etc.) obtained by substitution of an alcoholic hydroxy group in the above-exemplified low-molecular-weight diols with an amino group; polyoxypropylenediamine, polyoxyethylenediamine and like polyetherdiamines; menthanediamine, isophoronediamine, norbornenediamine, bis(4-amino-3-methyldicyclohexyl)methane, diaminodicyclohexylmethane, bis(aminomethyl)cyclohexane, 3,9-bis(3-aminopropyl)2,4,8,10-tetraoxaspiro(5, 5)undecane and like alicyclic diamines; m-xylenediamine, α-(m/paminophenyl)ethylamine, m-phenylenediamine, diaminodiphenylmethane, diaminodiphenylsulfone, diaminodiethyldimethyldiphenylmethane, diaminodiethyldiphenylmethane, dimethylthiotoluenediamine, diethyltoluenediamine, α,α'-bis(4-aminophenyl)-p-disopropylbenzene and like aromatic diamines; hydrazines; and dicarboxylic acid dihydrazide compounds, which are compounds formed between dicarboxylic acids exemplified by the polycarboxylic acids used for the polyester polyols, and hydrazines. Of these diamine compounds, low-molecular-weight diamines are preferable because they are low cost, with ethylenediamines being more preferable.

Further, a carboxy-neutralizing component (c4) may be used, if necessary. The carboxy-neutralizing component (c4) is a basic compound that reacts with a carboxy group in the carboxy-containing diol and forms a hydrophilic salt. Examples thereof include trimethylamine, triethylamine, tributylamine and like trialkylamines; N,N-dimethylethanolamine, N,N-dimethylpropanolamine, N,N-dipropylethanolamine, 1-dimethylamino-2-methyl-2-propanol and like N,N-dialkyl alkanolamines; N-alkyl-N,N-dialkanolamines; trialkanolamines (such as triethanolamine) and like tertiary amine compounds; ammonia; trimethyl ammonium hydroxide; sodium hydroxide; potassium hydroxide; lithium hydroxide; etc. Of these, tertiary amine compounds are preferable because the dispersion stability of the resulting urethane resin emulsion (C) is good.

In addition to (c1) to (c4) described above, the urethane resin emulsion (C) may also use an internal branching agent for imparting the polyurethane molecules with a branched structure and/or an internal cross-linking agent for imparting the polyurethane molecules with a cross-linking structure. Examples of these internal branching agents and internal cross-linking agents include trimethyloipropane and the like.

The method for producing the urethane resin emulsion (C) is not particularly limited; methods widely known in the relevant technical field may be used. A preferable production method is as follows: a prepolymer or polymer is synthesized in a solvent that is inert to reaction and has high hydrophilicity, and the resulting product is fed to water to be dispersed. Examples include: (A) a method in which a prepolymer is synthesized from the polyisocyanate component (c1) and the polyol component (c2) in the above solvent, and the resulting product is reacted in water with the amine component (c3), which is used if necessary; and (B) a method in which a polymer is synthesized from the polyisocyanate component (c1), the polyol component (c2), and the amine component (c3), which is used if necessary, and the resulting product is fed to water to be dispersed. Additionally, the neutralizing agent component may be added in advance to water to which the resulting product is fed, or may be added to water after the resulting product is fed.

Examples of solvents that are inert to reaction and have high hydrophilicity, which are used in the preferable production method, include acetone, methyl ethyl ketone, dioxane, tetrahydrofuran, N-methyl-2-pyrrolidone, etc. These solvents are usually used in an amount of 3 to 100 mass % relative to the total amount of the starting materials used for producing a prepolymer.

In the above production methods, the composition ratio is not particularly limited. The composition ratio can be expressed in the molar ratio of isocyanate groups in the polyisocyanate component (c1) to isocyanate-reactive groups in the polyol component (c2) and the amine component (c3), which is used if necessary. The molar ratio is preferably 1 (isocyanate groups): 0.5-2.0 (isocyanate-reactive groups), because when the amount of unreacted isocyanate groups in the dispersed polyurethane molecules is insufficient, the adhesion and/or strength of the coating film may be reduced when the product is used as a coating composition, and the dispersion stability and/or properties of the coating composition may be affected by the unreacted isocyanate groups when they are present in excess. Additionally, the molar ratio of isocyanate-reactive groups in the polyol component (c2) to isocyanate groups in the polyisocyanate component (c1) is preferably 0.3-1.0:1, more preferably 0.5-0.9:1. Further, the molar ratio of isocyanate-reactive groups in the amine component (c3), which is used if necessary, to isocyanate groups in the polyisocyanate component is 0.1-1.0:1, more preferably 0.2-0.5:1.

Furthermore, the rate of neutralization by the carboxy-neutralizing component (c4) is set to a range that imparts sufficient dispersion stability to the resulting urethane resin emulsion (C). The carboxy-neutralizing component is preferably used in the equivalent of 0.5 to 2.0 times, more preferably 0.7 to 1.5 times, per molecule of carboxy groups in the polyol component (c2).

In order to stabilize the dispersibility of the urethane resin emulsion (C), emulsifiers such as a surfactant and the like may be used singly, or in a combination of two or more. Although the particle size is not particularly limited, it is preferably 1 μm or less, more preferably 500 nm or less so as to maintain a good dispersion state.

Usable examples of the emulsifiers include surfactants widely known in the relevant technical field, such as anionic surfactants, nonionic surfactants, cationic surfactants, amphoteric surfactants, polymeric surfactants, reactive surfactants, etc., which are used in urethane resin emulsion. When these surfactants are used, anionic surfactants, nonionic surfactants, or cationic surfactants are preferable because they are low cost and can provide good emulsification.

Examples of the anionic surfactants include sodium dodecyl sulfate, potassium dodecyl sulfate, ammonium dodecyl sulfate and like alkylsulfates; sodium dodecyl polyglycol ether sulfate; sodium sulphoricinoleate; alkali metal salts of sulfonated paraffin, ammonium salts of sulfonated paraffin and like alkyl sulfonates; sodium laurate, triethanolamine oleate, triethanol amine abietate and like fatty acid salts; sodium benzene sulfonate, alkali metal sulfates of alkali phenol hydroxyethylene and like alkyl aryl sulfonates; higher alkylnaphthalenesulfonates; naphthalenesulfonic acid-formalin condensates; dialkyl sulfosuccinates; polyoxyethylene alkyl sulfates; polyoxyethelene alkyl aryl sulfates; etc.

Examples of the nonionic surfactants include $C_1$-$C_{18}$ alcohol-ethylene oxide and/or propylene oxide adducts; alkylphenol-ethylene oxide and/or propylene oxide adducts; alkylene glycol and/or alkylene diamine-ethylene oxide and/or propylene oxide adducts; etc.

Examples of $C_1$-$C_{18}$ alcohols forming the nonionic surfactants include methanol, ethanol, propanol, 2-propanol, butanol, 2-butanol, tertiary butanol, amyl alcohol, isoamyl alcohol, tertiary amyl alcohol, hexanol, octanol, decane alcohol, lauryl alcohol, myristyl alcohol, palmitylalcohol, stearyl alcohol, etc. Examples of alkylphenols include phenol, methylphenol, 2,4-di-tertiary butylphenol, 2,5-di-tertiary butylphenol, 3,5-di-tertiary butylphenol, 4-(1,3-tetramethylbutyl)phenol, 4-isooctylphenol, 4-nonylphenol, 4-tertiary octylphenol, 4-dodecylphenol, 2-(3,5-dimethylheptyl)phenol, 4-(3,5-dimethylheptyl)phenol, naphthol, bisphenol A, bisphenol F, etc. Examples of alkylene glycols include ethylene glycol, 1,2-propanediol, 1,3-propanediol, 2-methyl-1,3-propanediol, 2-butyl-2-ethyl-1,3-propanediol, 1,4-butanediol, neopentyl glycol, 1,5-pentanediol, 3-methyl-1,5-pentanediol, 2,4-diethyl-1,5-pentanediol, 1,6-hexanediol, etc. Examples of alkylene diamines include these alkylene glycols in which alcoholic hydroxy groups are substituted with amino groups. Further, the ethylene oxide and propylene oxide adducts may be random or block adducts.

Examples of the cationic surfactants include primary to tertiary amine salts, quaternary ammonium salts (such as pyridinium salts, alkyl pyridinium salts, and alkyl halide quaternary ammonium salts), etc.

Although these emulsifiers may be used in an arbitrary amount with no particular limitation, the mass ratio of emulsifier to urethane resin is preferably 0.01-0.3:1, more preferably 0.05-0.2:1 because the dispersibility may not be sufficient when the ratio of emulsifier is 0.05 or less per urethane resin; and the properties such as water resistance, strength, and elongation at break of the resulting coating film obtained from the aqueous first colored coating composition may be reduced when the ratio of emulsifier exceeds 0.3 per urethane resin.

Commercial products may be used as the urethane resin emulsions (C). Examples of commercial products include the "Bayhydrol" series (Sumika Bayer Urethane Co., Ltd.), the "Superflex" series (Dai-Ichi Kogyo Seiyaku Co., Ltd.), etc.

Further, the amount of the solids content of the urethane resin emulsion (C) may be selected arbitrarily with no particular limitation. The solids content is preferably 10 to 50 mass % because the dispersibility and coating performance are good in that range, with 20 to 40 mass % being more preferable.

The average molecular weight of urethane resins dispersed in the urethane resin emulsion (C) is not particularly limited; any range that can impart dispersibility to the aqueous coating composition and form good coating films may be selected. The average molecular weight is preferably 1,000 to 500,000, more preferably 5,000 to 200,000. Further, the hydroxy value may also be selected arbitrarily with no particular limitation. The acid value is expressed in consumption (mg) of KOH per gram of resin, and is usually 0 to 100 mg KOH/g.

Aqueous First Colored Coating Composition (X)

The aqueous first colored coating composition (X) used in the method for forming a multilayer coating film of the present invention is an aqueous coating composition containing an acrylic resin (A), a curing agent (B), and a urethane resin emulsion (C).

The term "aqueous coating composition" as used herein is used in contrast to "organic solvent-based coating composition", and generally means a coating composition in which a coating film-forming resin, a pigment, etc. are dispersed and/or dissolved in water, or in a medium mainly consisting of water (aqueous medium). The aqueous coating composition (X) preferably contains water in an amount of about 10 to about 90 mass %, more preferably about 20 to about 80 mass %, and even more preferably about 30 to about 60 mass %.

The amounts of acrylic resin (A), curing agent (B), and urethane resin emulsion (C) in the aqueous first colored coating composition (X) are preferably as follows: the amount of acrylic resin (A) is 20 to 70 mass %, more preferably 25 to 60 mass %, and still more preferably 30 to 50 mass %; the amount of curing agent (B) is 5 to 20 mass %, more preferably 7.5 to 20 mass %, and still more preferably 10 to 20 mass %; the amount of urethane resin emulsion (C) is 10 to 50 mass %, more preferably 15 to 45 mass %, still more preferably 20 to 40 mass %, and further more preferably 30 to 40 mass %, based on the total amount of acrylic resin (A), curing agent (B), and urethane resin emulsion (C), on a solids basis.

An essential requirement for the first colored coating film formed by the aqueous first colored coating composition (X) is that the water swelling rate and organic solvent swelling rate after pre-drying are not higher than certain levels, whereby a second colored coating film with excellent smoothness can be formed on the first colored coating film having a low water swelling rate. Furthermore, the low organic solvent swelling rate of the first colored coating film can prevent the coated surface smoothness from decreasing, which is caused by swelling of the coating film due to an organic solvent contained in the clear coating composition. Therefore, the method for forming a multilayer coating film of the present invention can form a multilayer coating film with an excellent finished appearance.

The aqueous first colored coating composition (X) of the present invention may contain resins for modification, such as polyester resins, alkyd resins, silicon resins, fluororesins, and epoxy resins.

The aqueous first colored coating composition (X) preferably contains a pigment (D). Examples of the pigment (D) includes coloring pigments (D1), extender pigments (D2), and luster pigments (D3). Such pigments can be used singly, or in a combination of two or more.

When the aqueous first colored coating composition (X) contains a pigment (D), the amount of pigment (D) in the aqueous first colored coating composition (X) is typically 1 to 300 parts by mass, preferably 20 to 200 parts by mass, and even more preferably 50 to 150 parts by mass, per 100 parts by mass of the total amount of the acrylic resin (A), crosslinking agent (B), and urethane resin emulsion (C), on a solids basis.

It is particularly preferable that the aqueous first colored coating composition (X) contains a coloring pigment (D1) and/or an extender pigment (D2), and that the total content of the coloring pigment (D1) and the extender pigment (D2) in the aqueous first colored coating composition (X) is 40 to 300 parts by mass, more preferably 50 to 200 parts by mass, and even more preferably 60 to 150 parts by mass, per 100 parts by mass of the total amount of the acrylic resin (A), crosslinking agent (B), and urethane resin emulsion (C), on a solids basis.

Examples of the coloring pigment (D1) include titanium, oxide, zinc flower, carbon black, molybdenum red, Prussian blue, cobalt blue, azo pigments, phthalocyanine pigments, quinacridone pigments, isoindoline pigments, threne pigments, perylene pigments, dioxazine pigments, diketopyrrolopyrrole pigments, etc. Among these, titanium oxide and carbon black are preferable.

When the aqueous first colored coating composition (X) contains a coloring pigment (D1) as described above, the amount of coloring pigment (D1) is typically 1 to 300 parts by mass, preferably 3 to 200 parts by mass, and even more preferably 5 to 150 parts by mass, per 100 parts by mass of the total amount of the acrylic resin (A), crosslinking agent (B), and urethane resin emulsion (C), on a solids basis.

Examples of the extender pigment (D2) include clay, kaolin, barium sulfate, barium carbonate, calcium carbonate, talc, silica, alumina white, and the like. Among these, barium sulfate and talc are preferable.

It is particularly preferable that barium sulfate with an average primary particle size of 1 μm or less, more preferably 0.01 to 0.8 μm, is used as an extender pigment (D2) in the composition, because a multilayer coating film with an excellent appearance, i.e., with a high flip-flop effect and little metallic mottling, as well as excellent smoothness, can be obtained when the aqueous second colored coating composition (Y) described below contains a luster pigment (D3).

The average primary particle diameter of barium sulfate as used herein is determined by observing barium sulfate using a scanning electron microscope, and averaging the maximum diameters of 20 barium sulfate particles on a straight line drawn at random on the electron microscope photograph.

When the aqueous first colored coating composition (X) contains an extender pigment (D2) as described above, the amount of extender pigment (D2) is typically 1 to 300 parts by mass, preferably 5 to 200 parts by mass, and even more preferably 10 to 150 parts by mass, per 100 parts by mass of the total amount of the acrylic resin (A), crosslinking agent (B), and urethane resin emulsion (C), on a solids basis.

Examples of the luster pigment (D3) include aluminum (such as vapor-deposited aluminum), copper, zinc, brass, nickel, aluminum oxide, mica, titanium oxide- and/or iron oxide-coated aluminum oxide, titanium oxide- and/or iron oxide-coated mica, glass flakes, holographic pigments, etc. Such luster pigments (D3) can be used singly, or in a combination of two or more. Examples of aluminum pigments include non-leafing aluminum pigments leafing and aluminum pigments; any of the pigments can be used.

When the aqueous first colored coating composition (X) contains a luster pigment (D3) as described above, the amount of luster pigment (D3) is typically 1 to 50 parts by mass, preferably 2 to 30 parts by mass, and even more preferably 3 to 20 parts by mass, per 100 parts by mass of the total amount of the acrylic resin (A), crosslinking agent (B), and urethane resin emulsion (C), on a solids basis.

The aqueous first colored coating composition (X) preferably further contains a hydrophobic solvent (E) in view of enhanced sagging resistance and popping resistance.

The hydrophobic solvent (E) is desirably an organic solvent of which a mass of 10 g or less, preferably 5 g or less, and more preferably 1 g or less, dissolves in 100 g of water at 20° C. Examples of the organic solvent include hydrocarbon solvents such as rubber solvents, mineral spirits, toluene, xylene, and solvent naphtha; alcoholic solvents such as 1-hexanol, 1-octanol, 2-octanol, 2-ethyl-1-hexanol, 1-decanol, benzyl alcohol, ethylene glycol mono-2-ethylhexyl ether, propylene glycol mono-n-butyl ether, dipropylene glycol mono-n-butyl ether, tripropylene glycol mono-n-butyl ether, propylene glycol mono-2-ethylhexyl ether, and propylene glycol monophenyl ether; ester solvents such as n-butyl acetate, isobutyl acetate, isoamyl acetate, methylamyl acetate, and ethylene glycol monobutyl ether acetate; ketone solvents such as methyl isobutyl ketone, cyclohexanone, ethyl n-amyl ketone, and diisobutyl ketone; etc. Such solvents can be used singly, or in a combination of two or more.

The hydrophobic solvent (E) is preferably an alcohol hydrophobic solvent in view of smoothness of the resulting coating film. $C_{7-14}$ hydrophobic alcoholic solvents are particularly preferable. It is more preferable to use at least one hydrophobic alcoholic solvent selected from the group consisting of 1-octanol, 2-octanol, 2-ethyl-1-hexanol, ethylene glycol mono-2-ethylhexyl ether, propylene glycol mono-n-butyl ether, and dipropylene glycol mono-n-butyl ether.

When the aqueous first colored coating composition (X) contains a hydrophobic solvent (E) as mentioned above, the amount of hydrophobic solvent (E) is preferably 2 to 40 parts by mass, more preferably 5 to 35 parts by mass, and even more preferably 10 to 30 parts by mass, per 100 parts by mass of the total amount of the acrylic resin (A), crosslinking agent (B), and urethane resin emulsion (C), on a solids basis.

If necessary, the aqueous first colored coating composition (X) may contain additives for coating compositions, such as thickeners, UV absorbers, light stabilizers, curing catalysts, antifoaming agents, plasticizers, organic solvents other than the hydrophobic solvent (E), surface control agents, and anti-settling agents.

Examples of thickeners include inorganic thickeners such as silicate, metal silicate, montmorillonite, and colloidal alumina; polyacrylic acid thickeners such as copolymers of (meth)acrylic acid and (meth)acrylic ester, and sodium polyacrylate; associative thickeners having a hydrophilic moiety and a hydrophobic moiety per molecule, and effectively enhancing the viscosity in an aqueous medium by adsorption of the hydrophobic moiety on the surface of a pigment or emulsion particles in a coating composition, or by association between hydrophobic moieties; cellulosic thickeners such as carboxymethylcellulose, methylcellulose, and hydroxyethylcellulose; protein thickeners such as casein, sodium caseinate, and ammonium caseinate; alginate thickeners such as sodium alginate; polyvinyl thickeners such as polyvinyl alcohol, polyvinylpyrrolidone, and polyvinyl benzyl ether copolymers; polyether thickeners such as Pluronic polyether, polyether dialkyl ester, polyether dialkyl ether, and polyether epoxy-modified products; maleic anhydride copolymer thickeners such as partial esters of vinyl methyl ether-maleic anhydride copolymers; polyamide thickeners such as polyamide amine; etc. Such thickeners can be used singly, or in a combination of two or more.

Examples of usable polyacrylic acid thickeners include commercially available products, which are available, for example, under the trade names "PRIMAL ASE-60", "PRIMAL TT-615", and "PRIMAL RM-5", manufactured by Rohm and Haas; "SN Thickener 613", "SN Thickener 618", "SN Thickener 630", "SN Thickener 634", and "SN Thickener 636", manufactured by San Nopco Ltd.; etc. Examples of usable associative thickeners include commercially available products, which are available, for example, under the trade names "UH-420", "UH-450", "UH-462", "UH-472", "UH-540", "UH-752", "UH-756VF", and "UH-814N", manufactured by ADEKA Co. Ltd.; "PRIMAL RM-8W", "PRIMAL RM-825", "PRIMAL RM-2020NPR", "PRIMAL RM-12W", and "PRIMAL SCT-275", manufactured by Rohm and Haas; "SN Thickener 612", "SN Thickener 621N", "SN Thickener 625N", "SN Thickener 627N", and "SN Thickener 660T", manufactured by San Nopco Ltd.; etc.

The thickener is preferably a polyacrylic acid thickener and/or an associative thickener, more preferably an associative thickener, and still more preferably a urethane associative thickener bearing a hydrophobic group at an end or ends and having a urethane bond in a molecular chain. Examples of usable urethane associative thickeners include commercially available products, which are available, for example, under the trade names "UH-420", "UH-462", "UH-472", "UH-540", "UH-752", "UH-756VF", and "UH-814N", manufactured by ADEKA Co. Ltd.; "SN thickener 612", "SN thickener 621N", "SN thickener 625N", "SN thickener 627N", and "SN thickener 660T", manufactured by San Nopco Ltd.; etc.

When the aqueous first colored coating composition (X) contains a thickener as described above, the amount of thickener is preferably 0.01 to 10 parts by mass, more preferably 0.02 to 3 parts by mass, and still more preferably 0.03 to 2 parts by mass, per 100 parts by mass of the total amount of the acrylic resin (A), crosslinking agent (B) and urethane resin emulsion (C), on a solids basis.

The aqueous first colored coating composition (X) can be prepared by mixing and dispersing, in an aqueous medium, an acrylic resin (A), a curing agent (B), and a urethane resin emulsion (C), together with, if necessary, a pigment (D), a hydrophobic solvent (E), and other additives for coating compositions, by using a known method. Examples of the aqueous medium include deionized water, and a mixture of deionized water and a hydrophilic organic solvent. Examples of the hydrophilic organic solvent include propylene glycol monomethyl ether, and the like.

Preferably, the solids content of the aqueous first colored coating composition (X) is typically 30 to 70 mass %, more preferably 35 to 60 mass %, and still more preferably 45 to 55 mass %.

The aqueous first colored coating composition (X) may be a single-liquid type or multi-liquid type coating composition. In view of storage stability, the aqueous first colored coating composition (X) may be prepared as a two-liquid type coating composition composed of a main agent containing an acrylic resin (A) and a urethane resin emulsion (C); and a curing agent containing a crosslinking agent (B). It is usually preferable that the main agent further contains a pigment and a solvent, and that the curing agent further contains a curing catalyst and a solvent. The curing agent may further contain a surfactant.

Before use, the coating composition may be diluted to an appropriate viscosity by adding water and/or an organic solvent, etc. if necessary, and then applied.

The appropriate viscosity may vary depending on the formulation of the coating composition, but is typically in the range of about 20 to about 60 seconds, and preferably about 25 to about 50 seconds, as adjusted and measured at 20° C. using Ford cup viscometer No. 4.

The aqueous first colored coating composition (X) can be applied on a substrate by known methods such as air spray coating, airless spray coating, rotary atomization coating, and curtain coating. An electrostatic charge may be applied during coating. Among these, air spray coating, rotary atomization coating, etc. are preferable. Such a coating method can be performed once or several times until the desired film thickness is obtained.

Preferably, the aqueous first colored coating composition (X) is typically applied to a cured film thickness of 5 to 40 μm, more preferably 7 to 30 μm, and still more preferably 10 to 25 μm.

The coating film of the aqueous first colored coating composition (X) can be cured, for example, by heating at 120 to 170° C., particularly 130 to 160° C., for 10 to 40 minutes. Heat-curing can be performed by known heating means, for example, by using hot air furnaces, electric furnaces, infrared induction heating furnaces, and like drying furnaces.

The present invention provides a method for forming a multilayer coating film wherein a first colored coating film formed by using the aqueous first colored coating composition (X) has a water swelling rate of not higher than 100%, and an organic solvent swelling rate of not higher than 300%.

The "water swelling rate" and "water extraction rate" as used herein refer to values determined in the following manner.

First, a tin plate (50 mm×90 mm) degreased with isopropanol is weighed, and the weight is defined as a. The aqueous first colored coating composition (X) adjusted to a viscosity of 30 seconds as measured at 20° C. with Ford Cup No. 4 by adding deionized water is applied to the surface of the tin plate to a film thickness of 20 μm (when cured) by rotary atomization using an automatic coater. After being set in an air-conditioned booth (24° C., 68% RH), the coated plate is preheated at 80° C. for 3 minutes. The coated plate after preheating is weighed, and the weight is defined as b. The coated plate is then immersed in 20° C. deionized water for 3 minutes. After removing the coated plate from the deionized water, the deionized water is wiped from the coated plate with a rag. The coated plate is weighed, and the weight is defined as c. Subsequently, the coated plate is dried at 110° C. for 1 hour. The coated plate after cooling is weighed, and the weight is defined as d.

The values calculated by the following equations (1) and (2) are defined as the "water swelling rate" and "water extraction rate" as used herein.

$$\text{Water swelling rate (\%)}=(\{(c-a)/(d-a)\}-1)\times 100 \quad (1)$$

$$\text{Water extraction rate (\%)}=(1-\{(d-a)/(b-a)\})\times 100 \quad (2)$$

The "organic solvent swelling rate" and "organic solvent extraction rate" as used herein are values determined in the following manner.

First, a tin plate (50 mm×90 mm) degreased with isopropanol is weighed, and the weight is defined as a. The aqueous first colored coating composition (X) adjusted to a viscosity of 30 seconds as measured at 20° C. with Ford Cup No. 4 by adding deionized water is applied to the surface of the tin plate to a film thickness of 20 μm (when cured) by rotary atomization using an automatic coater. After being set in an air-conditioned booth (24° C., 68% RH), the coated plate is preheated at 80° C. for 3 minutes. The coated plate after preheating is weighed, and the weight is defined as b. Subsequently, the coated plate is immersed in 20° C. organic solvent for 1 minute. After removing the coated plate from the organic solvent, the surface of the plate coated with the aqueous first colored coating composition is not wiped, and the coated plate is stood upright on a rag to allow the solvent remaining on the surface of the coated plate to be absorbed in the rag for 30 seconds. The coated plate is weighed, and the weight is defined as c. Subsequently, the coated plate is dried at 110° C. for 1 hour. The coated plate after cooling is weighed, and the weight is defined as d.

The organic solvent used above is a mixed solvent of 3-ethoxyethyl propionate and butanol at a mixing ratio of 70:30 (parts by mass).

The values calculated according to the following equations (3) and (4) are defined as the "organic solvent swelling rate" and "organic solvent extraction rate" as used herein.

$$\text{Organic solvent swelling rate (\%)}=(\{(c-a)/(d-a)\}-1)\times 100 \quad (3)$$

$$\text{Organic solvent extraction rate (\%)}=(1-\{(d-a)/(b-a)\})\times 100 \quad (4)$$

When the water swelling rate is higher than 100%, poor finished appearance may result due to layer-mixing of the first and second colored coating films. When the organic solvent swelling rate is higher than 300%, poor finished appearance may result due to formation of a fine recess-protrusion pattern on the first colored coating film layer.

The first colored coating film has a water swelling rate of not higher than 100%, preferably not higher than 60%, and more preferably not higher than 20%. The first colored coating film has an organic solvent swelling rate of not higher than 300%, preferably not higher than 250%, and more preferably not higher than 200%.

Step (2)

Subsequently, the aqueous second colored coating composition (Y) is applied to the coating layer of the aqueous first colored coating composition (X) (the first colored coating film) formed in Step (1).

Before application of the aqueous second colored coating composition (Y), the first colored coating film is preferably subjected to preheating, air blowing, etc. under conditions in which the coating film is not substantially cured. In the present invention, the "cured coating film" indicates a film in a "hardening drying" state according to JIS K 5600-1-1, i.e., a film in a condition such that when the center of the coated surface is strongly pinched between the thumb and forefinger, no fingerprint impression is left on the coated surface and no shifting of the coating film is observed; or when the center of the coated surface is repeatedly quickly rubbed with a fingertip, no traces of rubbing are left on the coated surface. The "uncured coating film" indicates a film that has not yet reached a dry-hard state as mentioned above, and includes coating films in a "Touch free" (dry to the touch) state and coating films in a "semi-hardening drying" state according to JIS K 5600-1-1.

The preheating temperature is preferably 40 to 120° C., more preferably 60 to 100° C., and still more preferably 70 to 90° C. The preheating time is preferably 30 seconds to 15 minutes, more preferably 1 to 12 minutes, and still more preferably 2 to 10 minutes. Air blowing can be typically performed by blowing either room temperature air, or air heated to 25 to 80° C., over the coated surface of the substrate for 30 seconds to 15 minutes.

Preferably, the first colored coating film is typically adjusted to a solids content of 60 to 100 mass %, more preferably 80 to 100 mass %, and still more preferably 90 to 100 mass %, by means of preheating, air blowing, etc., prior to the application of the aqueous second colored coating composition (Y).

The solids content of the first colored coating film can be determined by the following method:

First, the aqueous first colored coating composition (X) is simultaneously applied to a substrate and to an aluminum foil whose mass ($W_1$) has been measured in advance. After being subjected to preheating, etc., the coated aluminum foil is removed immediately before the application of the aqueous second colored coating composition (Y), and the mass ($W_2$) of the coated aluminum foil is measured. After the coated aluminum foil is dried at 110° C. for 60 minutes and allowed to cool to room temperature in a desiccator, the mass ($W_3$) of the coated aluminum foil is measured. The solids content of the first colored coating film is calculated according to the following equation.

$$\text{Solids content mass \%}=\{(W_3-W_1)\ /\ (W_2W_1)\}\times 100$$

The aqueous second colored coating composition (Y) applied to the first colored coating film is generally intended to impart an excellent appearance to the substrate to be coated. Usable as the coating composition (Y) are, for example, coating compositions prepared by dissolving or dispersing resin components comprising a base resin, such as an acrylic, polyester, alkyd, urethane or epoxy resin containing a crosslinkable functional group such as a carboxy or hydroxy group, and a curing agent such as a crosslinking agent (B) as mentioned above, together with a pigment and other additives, in water. Among these, thermosetting aqueous coating compositions containing a hydroxy-containing resin as the base resin and a melamine resin (b-1) as the crosslinking agent can be advantageously used in view of the appearance, water resistance, etc. of the resulting multilayer coating film.

The pigment may be a coloring pigment (D1), an extender pigment (D2), a luster pigment (D3), etc. It is particularly preferable that at least one of the pigments contained in the aqueous second colored coating composition (Y) is a coloring pigment (D1) and/or a luster pigment (D3).

Examples of the coloring pigment (D1) include titanium oxide, zinc flower, carbon black, molybdenum red, Prussian blue, cobalt blue, azo pigments, phthalocyanine pigments, quinacridone pigments, isoindoline pigments, threne pigments, perylene pigments, dioxazine pigments, diketopyrrolopyrrole pigments, etc. as mentioned in the description of the aqueous first colored coating composition (X).

It is preferable that when the aqueous second colored coating composition (Y) contains a coloring pigment (D1) as described above, the amount of coloring pigment (D1) is typically in the range of 1 to 150 parts by mass, more preferably 3 to 130 parts by mass, and even more preferably 5 to 110 parts by mass, per 100 parts by mass of the resin solids content in the aqueous second colored coating composition (Y).

Examples of the luster pigment (D3) include aluminum (for example, vapor-deposited aluminum), copper, zinc, brass, nickel, aluminum oxide, mica, titanium oxide- and/or iron oxide-coated aluminum oxide, titanium oxide- and/or iron oxide-coated mica, glass flakes, holographic pigments, etc. as mentioned in the description of the aqueous first colored coating composition (X). Among these, aluminum, aluminum oxide, mica, titanium oxide- and/or iron oxide-coated aluminum oxide, and titanium oxide- and/or iron oxide-coated mica are more preferable; and aluminum is particularly preferable. Such luster pigments (D3) can be used singly, or in a combination of two or more.

The luster pigment (D3) is preferably in the form of flakes. As the luster pigment (D3), pigments having a longitudinal dimension of 1 to 100 μm, particularly 5 to 40 μm, and a thickness of 0.001 to 5 μm, particularly 0.01 to 2 μm, are suitable.

It is suitable that when the aqueous second colored coating composition (Y) contains a luster pigment (D3) as described above, the amount of luster pigment (D3) is typically in the range of 1 to 50 parts by mass, more preferably 2 to 30 parts by mass, and even more preferably 3 to 20 parts by mass, per 100 parts by mass of the resin solids in the aqueous second colored coating composition (Y).

The aqueous second colored coating composition (Y) preferably contains a hydrophobic solvent (E) as mentioned above. The hydrophobic solvent (E) is preferably an alcohol hydrophobic solvent in view of excellent brilliance of the resulting coating film. In particular, $C_{7-14}$ alcohol hydrophobic solvents, such as at least one alcohol hydrophobic solvent selected from the group consisting of 1-octanol, 2-octanol, 2-ethyl-1-hexanol, ethylene glycol mono-2-ethylhexyl ether, propylene glycol mono-n-butyl ether, and dipropylene glycol mono-n-butyl ether, are preferable.

When the aqueous second colored coating composition (Y) contains a hydrophobic solvent (E), the amount of hydrophobic solvent (E) is preferably 2 to 70 parts by mass, more preferably 11 to 60 parts by mass, and even more preferably 16 to 50 parts by mass, per 100 parts by mass of the resin solids content in the aqueous second colored coating composition (Y).

The aqueous second colored coating composition (Y) may further contain, if necessary, additives usually used for coating compositions, such as curing catalysts, thickeners, UV absorbers, light stabilizers, antifoaming agents, plasticizers, organic solvents, surface control agents, and antisettling agents. Such additives can be used singly, or in a combination of two or more.

The aqueous second colored coating composition (Y) can be applied by known methods such as air spray coating, airless spray coating, and rotary atomization coating. An electrostatic charge may be applied during coating. The coating composition can typically be applied to a cured film thickness of 5 to 30 μm, preferably 8 to 25 μm, and more preferably 10 to 20 μm.

Step (3)

In the method for forming a multilayer coating film of the present invention, a clear coating composition (Z) is applied to the coating layer of the aqueous second colored coating composition (Y) (the second colored coating film) formed in the above step (2).

Before the application of the clear coating composition (Z), the second colored coating film is preferably subjected to preheating, air blowing, etc. under conditions in which the coating film is not substantially cured. The preheating temperature is preferably 40 to 100° C., more preferably 50 to 90° C., and still more preferably 60 to 80° C. The preheating time is preferably 30 seconds to 15 minutes, more preferably 1 to 10 minutes, and still more preferably 2 to 5 minutes. Air blowing can be typically performed by blowing either room temperature air, or air heated to 25 to 80° C., over the coated surface of the substrate for 30 seconds to 15 minutes.

It is preferable that before the application of the clear coating composition (Z), the second colored coating film is typically adjusted to a solids content of 70 to 100 mass %, more preferably 80 to 100 mass %, and still more preferably 90 to 100 mass %, if necessary, by means of preheating, air blowing, etc. as mentioned above.

As the clear coating composition (Z), any known thermosetting clear coating composition for coating automobile bodies etc. can be used. Examples of such thermosetting clear coating compositions include organic solvent-type thermosetting coating compositions, aqueous thermosetting coating compositions, and powder thermosetting coating compositions, all of which contain a crosslinking agent and a base resin having a crosslinkable functional group.

Examples of the crosslinkable functional group contained in the base resin include carboxy, hydroxy, epoxy, silanol, etc. Examples of the base resin include acrylic resins, polyester resins, alkyd resins, urethane resins, epoxy resins, fluororesins, etc. Examples of crosslinking agents include polyisocyanate compounds, blocked polyisocyanate compounds, melamine resins, urea resins, carboxy-containing compounds, carboxy-containing resins, epoxy-containing resins, epoxy-containing compounds, etc.

Examples of preferable combinations of base resin/crosslinking agent for the clear coating composition (Z) are carboxy-containing resin/epoxy-containing resin, hydroxy-containing resin/polyisocyanate compound, hydroxy-containing resin/blocked polyisocyanate compound, hydroxy-containing resin/melamine resin, etc.

The clear coating composition (Z) may be a single-liquid type coating composition, or a multi-liquid type coating composition such as a two-liquid type urethane resin coating composition.

If necessary, the clear coating composition (Z) may contain coloring pigments (D1), luster pigments (D3), dyes, etc., in amounts such that the transparency of the clear coating composition is not impaired; and may further contain extender pigments (D2), UV absorbers, light stabilizers, antifoaming agents, thickening agents, anticorrosives, surface control agents, etc.

The clear coating composition (Z) can be applied to the surface coated with the aqueous second colored coating composition (Y) by known methods, such as airless spray coating, air spray coating, and rotary atomization coating. An electrostatic charge may be applied during coating. The clear coating composition (Z) can typically be applied to a cured film thickness of 20 to 80 μm, preferably 25 to 60 μm, and more preferably 30 to 50 μm.

After application of the clear coating composition (Z), if necessary, an interval of about 1 to about 60 minutes may be placed at room temperature, or preheating may be performed at about 50 to about 110° C. for about 1 to about 30 minutes.

Step (4)

In the method for forming a multilayer coating film of the present invention, the uncured first colored coating film, uncured second coating film, and uncured clear coating film formed in Steps (1) to (3) are simultaneously heat-cured.

The first colored coating film, the second colored coating film, and the clear coating film are cured by a usual method for baking coating films, such as air-blowing, infrared heating, or high frequency heating. The heating temperature is preferably 80 to 180° C., more preferably 110 to 170° C., and still more preferably 130 to 160° C. The heating time is preferably 10 to 90 minutes, and more preferably 15 to 60 minutes. This heating allows a multilayer coating film consisting of three layers, i.e., the first colored coating film, second colored coating film, and clear coating film, to be simultaneously cured.

EXAMPLES

The present invention is described below in more detail with reference to Examples and Comparative Examples.

However, the present invention is not limited to these examples. In the examples, "parts" and "%" are expressed on a mass basis. The thickness of the coating film refers to the thickness of the coating film when cured.

Production of a Hydroxy-Containing Acrylic Resin

Production Example 1

A reaction vessel equipped with a thermometer, a thermostat, a stirrer, a reflux condenser, a nitrogen inlet tube, and a dropper was charged with 30 parts of propylene glycol monopropyl ether. After the solvent was heated to 85° C., a mixture of 10 parts of styrene, 30 parts of methyl methacrylate, 15 parts of 2-ethylhexyl acrylate, 11.5 parts of n-butyl acrylate, 30 parts of 2-hydroxyethyl acrylate, 3.5 parts of acrylic acid, 10 parts of propylene glycol monopropyl ether, and 2 parts of 2,2'-azobis(2,4-dimethylvaleronitrile) was added dropwise over a period of 4 hours, and aged for 1 hour after completion of the addition. A mixture of 5 parts of propylene glycol monopropyl ether and 1 part of 2,2'-azobis(2,4-dimethylvaleronitrile) was then added dropwise to the reaction mixture in a flask over 1 hour, and aged for 1 hour after completion of the addition. Further, 3.03 parts of 2-(dimethylamino)ethanol was added, and deionized water was gradually added to obtain a hydroxy-containing acrylic resin solution (A-1) with a solids content of 40%. The obtained hydroxy-containing acrylic resin had an acid value of 27 mg KOH/g, a weight average molecular weight of about 60,000, and a hydroxy value of 145 mg KOH/g.

Production Example 2

A reaction vessel equipped with a thermometer, a thermostat, a stirrer, a reflux condenser, a nitrogen inlet tube and a dropper was charged with 130 parts of deionized water and 0.52 parts of "Aqualon KH-10" (trade name, a product of Dai-ichi Kogyo Seiyaku Co., Ltd., a polyoxyethylene alkyl ether sulfate ester ammonium salt, active ingredient: 97%). The mixture was stirred in a nitrogen stream, and heated to 80° C. Subsequently, a 1% quantity of the total amount of the monomer emulsion (1) shown below and 5.3 parts of a 6% aqueous ammonium persulfate solution were introduced into the reaction vessel, and the mixture was maintained at 80° C. for 15 minutes. Subsequently, the remainder of the monomer emulsion (1) was added dropwise to the reaction vessel retained at the same temperature over a period of 3 hours, and the mixture was aged for 1 hour after completion of the addition.

Subsequently, the monomer emulsion (2) shown below was added dropwise over a period of 1 hour, and the mixture was aged for 1 hour. While 40 parts of a 5% aqueous 2-(dimethylamino)ethanol solution was gradually added into the reaction vessel, the mixture was cooled to 30° C., and then filtered with a nylon cloth to obtain, as a filtrate, a hydroxy-containing acrylic resin dispersion (A-2) with a solids content of 30% and an average particle diameter of 100 nm (as measured at 20° C. using a "COULTER N4" submicron particle size distribution analyzer (manufactured by Beckman Coulter, Inc.) in a state diluted with deionized water). The obtained hydroxy-containing acrylic resin had an acid value of 25.3 mg KOH/g, and a hydroxy value of 19.2 mg KOH/g.

Monomer emulsion (1): 46.2 parts of deionized water, 0.79 parts of "Aqualon KH-10", 2.3 parts of methylene bisacrylamide, 3.1 parts of styrene, 11 parts of methyl methacrylate, 11 parts of ethyl acrylate, and 49.6 parts of n-butyl acrylate were mixed and stirred to obtain a monomer emulsion (1).

Monomer emulsion (2): 13.8 parts of deionized water, 0.24 parts of "Aqualon KH-10", 0.02 parts of ammonium persulfate, 3.9 parts of methacrylic acid, 3.9 parts of 2-hydroxyethyl acrylate, 2.3 parts of styrene, 4.6 parts of methyl methacrylate, 1.4 parts of ethyl acrylate, and 6.9 parts of n-butyl acrylate were mixed and stirred to obtain a monomer emulsion (2).

Production Example 3

The procedure of Production Example 2 was repeated, except that the monomer emulsion (3) shown below was used in place of the monomer emulsion (2). As a result, a hydroxy-containing acrylic resin dispersion (A-3) with an average particle diameter of 120 nm and a solids content of 30% was obtained. The obtained hydroxy-containing acrylic resin had an acid value of 12.3 mg KOH/g, and a hydroxy value of 19.2 mg KOH/g.

Monomer emulsion (3): 13.8 parts of deionized water, 0.24 parts of "Aqualon KH-10", 0.02 parts of ammonium persulfate, 1.9 parts of methacrylic acid, 3.9 parts of 2-hydroxyethyl acrylate, 2.3 parts of styrene, 6.6 parts of methyl methacrylate, 1.4 parts of ethyl acrylate, and 6.9 parts of n-butyl acrylate were mixed and stirred to obtain a monomer emulsion (3).

Production Example 4

The procedure of Production Example 2 was repeated, except that the monomer emulsion (4) shown below was used in place of the monomer emulsion (2). As a result, a hydroxy-containing acrylic resin solution (A-4) with an average particle diameter of 200 nm and a solids content of 30% was obtained. The obtained hydroxy-containing acrylic resin had an acid value of 5 mg KOH/g, and a hydroxy value of 19.2 mg KOH/g.

Monomer emulsion (4): 13.8 parts of deionized water, 0.24 parts of "Aqualon KH-10", 0.02 parts of ammonium persulfate, 0.8 parts of methacrylic acid, 3.9 parts of 2-hydroxyethyl acrylate, 2.3 parts of styrene, 7.7 parts of methyl methacrylate, 1.4 parts of ethyl acrylate, and 6.9 parts of n-butyl acrylate were mixed and stirred to obtain a monomer emulsion (4).

Production Example 5

Production Example 5-1

Synthesis of a Urea Group-Containing Polymerizable Unsaturated Monomer (S-1-1)

A four-necked flask equipped with a stirrer, a thermometer, a drying tube, and a dropping funnel was charged with 40 parts of tetrahydrofuran and 52.9 parts of 2-methacryloyloxy ethylisocyanate. The mixture was cooled to 15° C. Subsequently, while the mixture was maintained at a temperature not higher than 20° C. with stirring, 37 parts of a 37.8% solution of ethylamine in methanol was added dropwise over a period of 1 hour. The mixture was further maintained at room temperature with stirring for 2 hours. Subsequently, the temperature was raised to 60° C., and the solvent was removed under reduced pressure to obtain an ethylurea group-containing polymerizable unsaturated monomer (S-1-1) (active ingredient: 100%).

Production Example 5-2

A reaction vessel equipped with a thermometer, a thermostat, stirrer, a reflux condenser, a nitrogen inlet tube, and a dropper was charged with 130 parts of deionized water, and 0.52 parts of "Aqualon KH-10" (trade name, manufactured by Daiichi Kogyo Seiyaku Co., Ltd., a polyoxyethylene alkyl ether sulfate ester ammonium salt, active ingredient: 97%). The resulting mixture was stirred and mixed in a nitrogen stream, and heated to 80° C.

Subsequently, a 1% quantity of the total amount of the monomer emulsion (5) shown below and 5.3 parts of a 6% aqueous solution of ammonium persulfate were introduced into the reaction vessel, and maintained at 80° C. for 15 minutes.

The remainder of the monomer emulsion (5) was then added dropwise into the reaction vessel retained at the same temperature over a period of 3 hours, and the mixture was aged for 1 hour after completion of the addition.

The monomer emulsion (6) shown below was then added dropwise over a period of 1 hour, and the mixture was aged for 1 hour. While 40 parts of a 5% aqueous solution of 2-(dimethylamino)ethanol was gradually added into the reaction vessel, the mixture was cooled to 30° C. to obtain a hydroxy-containing acrylic resin dispersion (A-5) with a solids content of 30% and an average particle diameter of 138 nm (as measured at 20° C. using a "COULTER N4" submicron particle size distribution analyzer (manufactured by Beckman Coulter, Inc.) in a state diluted with deionized water). The obtained hydroxy-containing acrylic resin had a hydroxy value of 9.4 mg KOH/g, and an acid value of 14.3 mg KOH/g.

Monomer emulsion (5): 46.2 parts of deionized water, 0.79 parts of "Aqualon KH-10", 10.0 parts of n-butyl acrylate, 52.4 parts of methyl methacrylate, 11.6 parts of ethyl acrylate, and 3.08 parts of ethylene glycol dimethacrylate were mixed and stirred to obtain a monomer emulsion (5) (total core monomer content: 77 parts).

Monomer emulsion (6): 13.8 parts of deionized water, 0.24 parts of "Aqualon KH-10", 0.03 parts of ammonium persulfate, 6.9 parts of the ethylurea group-containing polymerizable unsaturated monomer (S-1-1), 2.99 parts of styrene, 4.37 parts of n-butyl acrylate, 4.37 parts of methyl methacrylate, 2.19 parts of 2-hydroxyethyl methacrylate, and 2.19 parts of methacrylic acid were mixed and stirred to obtain a monomer emulsion (6) (total shell monomer content: 23 parts).

Production of a Urethane Resin Emulsion

Production Example 6

A reaction vessel equipped with a thermometer, a thermostat, a stirrer, a reflux condenser, and a water separator was charged with 61.9 parts of PLACCEL-205 (polycaprolactone diol, manufactured by Daicel Chemical Industries, Ltd.), and 5.8 parts of dimethylolpropionic acid. The mixture was heated to 80° C. with stirring. After the temperature reached 80° C., 32.4 parts of isophorone diisocyanate was added dropwise over a period of 1 hour. After addition of 29.9 parts of N-methylpyrrolidone, the mixture was further aged at 80° C. to allow a urethanization reaction to proceed. When the isocyanate value became 3.0 or less, the heating was terminated, and 2.75 parts of triethylamine was added at 70° C.

Subsequently, while the mixture was maintained at 50° C., 200 parts of deionized water was added dropwise over a period of 1 hour to disperse the mixture in water. As a result, a urethane resin emulsion (C-1) was obtained.

The obtained urethane resin emulsion (C-1) had a solids content of 30%, a urethane bond amount of 1.46 mmol, and an acid value of 21.8 mg KOH/g. The particle size as measured by dynamic light scattering was 77 nm.

Production Examples 7 to 18

Urethane resin emulsions (C-2) to (C-13) were synthesized in the same manner as in Production Example 6 according to the formulations shown in Table 1.

In Table 1, (*1) to (*6) mean the following.

(*1) PRIPOL: PRIPOL 2033, a fatty acid-derived dimer diol (a polyol containing an ester bond), molecular weight: 540, manufactured by Croda (*2) UM-CARB: a polycarbonate diol comprising a mixture of 1,4-cyclohexanedimethanol and 1,6-hexanediol at a mixing ratio of 3:1, molecular weight 900, manufactured by Ube Industries, Ltd.

((*1) PRIPOL and (*2) UM-CARB are both hydrophobic diols obtained by reacting a component comprising at least 50 mass % of a hydrocarbon group containing 6 or more carbon atoms.)

(*3) DMPA: dimethylolpropionic acid (*4) 1,4-BD: 1,4-butanediol (*5) HMDI: hexamethylene diisocyanate (*6) IPDI: isophorone diisocyanate (*7) Hydrogenated MDI: dicyclohexylmethane-4,4'-diisocyanate

TABLE 1

| | | PLACCEL205 | PLIPOL*1 | UMCARB*2 | DMPA*3 | 1,4BD*4 | HMDI*5 | IPDI*6 | Hydrogenated MDI *7 |
|---|---|---|---|---|---|---|---|---|---|
| Production Example 6 | C-1 | 61.9 | | | 5.8 | | | 32.4 | |
| Production Example 7 | C-2 | 54.3 | | | 5.5 | 3.1 | | 37.2 | |
| Production Example 8 | C-3 | 45.6 | | | 5.7 | 6.3 | | 42.5 | |
| Production Example 9 | C-4 | 63.2 | | | 5.9 | | | 30.9 | |
| Production Example 10 | C-5 | | 58.4 | | 8 | | | 33.6 | |
| Production Example 11 | C-6 | | | 67.8 | 6.9 | | 25.27 | | |
| Production Example 12 | C-7 | | | 59.8 | 6.9 | | | 33.3 | |
| Production Example 13 | C-8 | | | 53.8 | 6.9 | | | | 39.3 |

TABLE 1-continued

| | | PLACCEL205 | PLIPOL*1 | UMCARB*2 | DMPA*3 | 1,4BD*4 | HMDI*5 | IPDI*6 | Hydrogenated MDI *7 |
|---|---|---|---|---|---|---|---|---|---|
| Production Example 14 | C-9 | | | 33.8 | 6.3 | 10.4 | | | 49.5 |
| Production Example 15 | C-10 | | | 64.6 | 4.2 | | | | 31.2 |
| Production Example 16 | C-11 | | | 70.5 | 5.8 | | | 23.8 | |
| Production Example 17 | C-12 | | | 70.5 | 5.8 | | | | 23.8 |
| Production Example 18 | C-13 | | | 85.3 | 5.8 | | | | 9.0 |

Production of a Hydroxy- and Carboxy-containing Polyester Resin (for Comparative Examples)

Production Example 19

A reaction vessel equipped with a thermometer, a thermostat, a stirrer, a reflux condenser, and a water separator was charged with 88 parts of adipic acid, 536 parts of 1,2-cyclohexanedicarboxylic acid anhydride, 199 parts of isophthalic acid, 288 parts of 2-butyl-2-ethyl-1,3-propanediol, 95 parts of neopentylglycol, 173 parts of 1,4-cyclohexanedimethanol, and 287 parts of trimethylolpropane, and the temperature was raised from 160 to 230° C. over a period of 3 hours. While distilling off the formed water of condensation using the water separator, the reaction was continued at 230° C. until the acid value of the reaction product became 5 mg KOH/g or less. Eighty-six parts of trimellitic anhydride was added to this reaction product, and an addition reaction was carried out at 170° C. for 30 minutes. After the reaction product was cooled to 50° C. or less and neutralized by adding 2-(dimethylamino)ethanol in an amount of 0.9 equivalents to the acid group, deionized water was gradually added to obtain an aqueous dispersion of hydroxy- and carboxy-containing polyester resin (A-6) with a solids content of 45% and a pH of 7.2. The obtained hydroxy- and carboxy-containing polyester resin had a hydroxy value of 110 mg KOH/g, an acid value of 33 mg KOH/g, and a number average molecular weight of 2050.

Production of an Aqueous First Colored Coating Composition (X)

Production Example 20

25.5 parts of the hydroxyl-containing acrylic resin solution (A-1) (resin solids content: 10.2 parts) obtained in Production Example 1, 87 parts of rutile titanium dioxide (D1-1) (trade name "JR-806", manufactured by Tayca Corporation), 0.8 parts of carbon black (D1-2) (trade name "carbon MA-100", manufactured by Mitsubishi Chemical, Inc.), and 43 parts of deionized water were mixed, and adjusted to pH 8.0 with 2-(dimethylamino)ethanol. The resulting mixture was then dispersed by a paint shaker for 30 minutes to obtain a pigment-dispersed paste.

Subsequently, 156 parts of the obtained pigment-dispersed paste, 116.7 parts of the hydroxy-containing acrylic resin dispersion (A-2) obtained in Production Example 2, 133.3 parts of the urethane resin emulsion (C-1) obtained in Production Example 5, and 21.4 parts of a melamine resin (B-1) (an imino group-containing methyl etherified melamine resin, weight average molecular weight: 800, solids content: 70%) were uniformly mixed.

Subsequently, ASE-60 (an alkaline swelling thickener, trade name, manufactured by Rohm & Haas Co.), 2-(dimethylamino)ethanol, and deionized water were added to the obtained mixture to obtain an aqueous first colored coating composition (X-1) with a pH of 8.2, with a coating solids content of 44%, with a viscosity of 30 seconds as measured at 20° C. using Ford Cup No. 4. When the aqueous first colored coating composition (X-1) was applied to a film thickness of 20 μm (when cured) and heated at 80° C. for 3 minutes, the resulting coating film had a water swelling rate of 63%, and an organic solvent (a mixed solvent of 3-ethoxyethyl propionate and butanol at a mixing ratio of 70:30 (parts by mass)) swelling rate of 229%.

Production Examples 21 to 39

The procedure of Production Example 20 was repeated using the materials shown in Table 2 below as acrylic resins, polyester resin, melamine resin, blocked polyisocyanate compound, and urethane resins in the amounts shown in Table 2. As a result, aqueous first colored coating compositions (X-2) to (X-20) with a pH of 8.2, a coating solids content of 44%, and a viscosity of 30 seconds as measured at 20° C. using Ford Cup No. 4 were obtained. Desmodule BL3475 (diethyl malonate blocked hexamethylene diisocyanate, manufactured by Bayer Holding Ltd.) was used as the blocked polyisocyanate compound (B-3).

The amounts shown in Table 2 are all on a solids basis.

TABLE 2

| Production Example | 20 | 21 | 22 | 23 | 24 | 25 | 26 | 27 | 28 | 29 | 30 |
|---|---|---|---|---|---|---|---|---|---|---|---|
| Aqueous first colored coating composition X- | 1 | 2 | 3 | 4 | 5 | 6 | 7 | 8 | 9 | 10 | 11 |
| Acrylic resin A-1 | 10 | 10 | 10 | 10 | 10 | 10 | 10 | 10 | 10 | 10 | 10 |
| Acrylic resin A-2 | 35 | 35 | 35 | 35 | 35 | 35 | 35 | 35 | 35 | 35 | 35 |
| Melamine resin B-1 | 15 | 15 | 15 | 15 | 15 | 15 | 15 | 15 | 15 | 15 | 15 |
| Urethane resin C-1 | 40 | | | | | | | | | | |
| Urethane resin C-2 | | 40 | | | | | | | | | |
| Urethane resin C-3 | | | 40 | | | | | | | | |

TABLE 2-continued

| | | | | | | | | | | | |
|---|---|---|---|---|---|---|---|---|---|---|---|
| Urethane resin C-4 | | | | 40 | | | | | | | |
| Urethane resin C-5 | | | | | 40 | | | | | | |
| Urethane resin C-6 | | | | | | 40 | | | | | |
| Urethane resin C-7 | | | | | | | 40 | | | | |
| Urethane resin C-8 | | | | | | | | 40 | | | |
| Urethane resin C-9 | | | | | | | | | 40 | | |
| Urethane resin C-10 | | | | | | | | | | 40 | |
| Urethane resin C-11 | | | | | | | | | | | 40 |
| Pigment | | | | | | | | | | | |
| Titanium dioxide (D1-1) | 87 | 87 | 87 | 87 | 87 | 87 | 87 | 87 | 87 | 87 | 87 |
| Carbon black (D1-2) | 0.8 | 0.8 | 0.8 | 0.8 | 0.8 | 0.8 | 0.8 | 0.8 | 0.8 | 0.8 | 0.8 |
| Water swelling rate (%) | 63 | 48 | 80 | 39 | 98 | 77 | 20 | 26 | 38 | 21 | 18 |
| Organic solvent swelling rate (%) | 229 | 263 | 265 | 245 | 297 | 298 | 239 | 205 | 225 | 240 | 262 |

| Production Example | 31 | 32 | 33 | 34 | 35 | 36 | 37 | 38 | 39 |
|---|---|---|---|---|---|---|---|---|---|
| Aqueous first colored coating composition X- | 12 | 13 | 14 | 15 | 16 | 17 | 18 | 19 | 20 |
| Acrylic resin A-1 | 10 | 10 | 10 | 10 | 10 | 10 | 10 | 10 | 10 |
| Acrylic resin A-2 | 35 | 35 | 35 | | 35 | 35 | 35 | | |
| Acrylic resin A-3 | | | | | | | 40 | | |
| Acrylic resin A-4 | | | | | | | | | 25 |
| Acrylic resin A-5 | | | | 35 | | | | | |
| Polyester resin A-6 | | | | | | | | 35 | 35 |
| Melamine resin B-1 | 15 | 20 | | 15 | 15 | 30 | 15 | 30 | 30 |
| Blocked polyisocyanate compound B-3 | | | 20 | | | | | | |
| Urethane resin C-1 | | | | | | | | 25 | |
| Urethane resin C-2 | | | | | | | | | |
| Urethane resin C-3 | | | | | | | | | |
| Urethane resin C-4 | | | | | | | | | |
| Urethane resin C-5 | | | | | | | | | |
| Urethane resin C-6 | | | | | | | | | |
| Urethane resin C-7 | | | | | | | | | |
| Urethane resin C-8 | | | | | | | | | |
| Urethane resin C-9 | | | | | | | | | |
| Urethane resin C-10 | | | | | | | | | |
| Urethane resin C-11 | | | | | | | | | |
| Urethane resin C-12 | 40 | 35 | 35 | 40 | | 25 | | | |
| Urethane resin C-13 | | | | | 40 | | | | |
| Pigment | | | | | | | | | |
| Titanium dioxide (D1-1) | 87 | 87 | 87 | 87 | 87 | 87 | 87 | 87 | 87 |
| Carbon black (D1-2) | 0.8 | 0.8 | 0.8 | 0.8 | 0.8 | 0.8 | 0.8 | 0.8 | 0.8 |
| Water swelling rate (%) | 20 | 30 | 25 | 15 | 12 | 45 | 10 | 120 | 20 |
| Organic solvent swelling rate (%) | 180 | 212 | 251 | 150 | 325 | 305 | 332 | 270 | 362 |

Production of a Polyester Resin for Aqueous Second Colored Coating Composition (Y)

Production Example 40

A reaction vessel equipped with a thermometer, a thermostat, a stirrer, a reflux condenser, and a water separator was charged with 109 parts of trimethylolpropane, 141 parts of 1,6-hexanediol, 126 parts of hexahydrophthalic anhydride, and 120 parts of adipic acid. After the temperature was raised from 160 to 230° C. over a period of 3 hours, the mixture was subjected to a condensation reaction at 230° C. for 4 hours. Subsequently, 38.3 parts of trimellitic anhydride was further added in order to add carboxy groups to the resulting condensation reaction product, and reacted at 170° C. for 30 minutes. The reaction product was diluted with 2-ethyl-1-hexanol to obtain a polyester resin solution with a solids content of 70%. The obtained polyester resin had an acid value of 46 mg KOH/g, a hydroxy value of 150 mg KOH/g, and a weight average molecular weight of 6,400.

Production of a Luster Pigment Dispersion

Production Example 41

In a stirred mixing vessel, 19 parts of an aluminum pigment paste, (trade name "GX-180A", Asahi Kasei Metals Co., Ltd., metal content: 74%), 35 parts of 2-ethyl-1-hexanol, 8 parts of a phosphate group-containing resin solution (Note 1), and 0.2 part of 2-(dimethylamino)ethanol were uniformly mixed to obtain a luster pigment dispersion.

(Note 1) Phosphate group-containing resin solution: a reaction vessel equipped with a thermometer, a thermostat, a stirrer, a reflux condenser, a nitrogen inlet tube, and a dropper was charged with a mixed solvent of 27.5 parts of methoxypropanol and 27.5 parts of isobutanol, and heated to 110° C. Subsequently, 121.5 parts of a mixture of 25 parts of styrene, 27.5 parts of n-butyl methacrylate, 20 parts of a branched higher alkyl acrylate (trade name "Isostearyl Acrylate", manufactured by Osaka Organic Chemical Industry, Ltd.), 7.5 parts of 4-hydroxybutyl acrylate, 15 parts of a phosphate group-containing polymerizable monomer (Note 2), 12.5 parts of 2-methacryloyloxyethyl acid phosphate, 10 parts of isobutanol, and 4 parts of tert-butylperoxyoctate was added to a mixed solvent over a period of 4 hours. Further, a mixture of 0.5 parts of tert-butylperoxyoctate and 20 parts of isopropanol was added dropwise over a period of 1 hour. Subsequently, the mixture was aged with stirring for 1 hour to obtain a phosphate group-containing resin solution with a solids content of 50%. The phosphate group-containing resin had an acid value attributable to phosphate groups of 83 mg KOH/g, a hydroxy value of 29 mg KOH/g, and a weight average molecular weight of 10,000.

(Note 2) The phosphate group-containing polymerizable monomer: a reaction vessel equipped with a thermometer, a thermostat, stirrer, a reflux condenser, a nitrogen inlet tube, and a dropper was charged with 57.5 parts of monobutylphosphoric acid and 41 parts of isobutanol. After the mixture was heated to 90° C., 42.5 parts of glycidyl methacrylate was added dropwise over a period of 2 hours. After the mixture was aged with stirring for 1 hour, 59 parts of isopropanol was added to obtain a phosphate group-containing polymerizable monomer solution with a solids content of 50%. The obtained monomer had an acid value attributable to phosphate groups of 285 mg KOH/g.

Production of an Aqueous Second Colored Coating Composition (Y)

Production Example 42

100 parts of the hydroxy-containing acrylic resin dispersion (A-2) (solids content: 30 parts) obtained in Production Example 2, 57 parts of the polyester resin solution (40 parts of solids) obtained in Production Example 40, 62 parts of the luster pigment dispersion (resin solids content: 4 parts) obtained in Production Example 41, and 37.5 parts of a melamine resin (solids content: 30 parts) (trade name "Cymel 325", manufactured by Nihon Cytec Industries, Inc., solids content: 80%) were uniformly mixed. Further, a polyacrylic acid thickener (trade name "Primal ASE-60", manufactured by Rohm & Haas Co.), 2-(dimethylamino)ethanol, and deionized water were added to obtain an aqueous second colored coating composition (Y-1) with a pH of 8.0, a coating solids content of 25%, and a viscosity of 40 seconds as measured at 20° C. using Ford Cup No. 4.

Production of Test Plates

Test plates were prepared in the following manner by using the aqueous first colored coating compositions (X-1) to (X-20) obtained in Production Examples 20 to 39, and the aqueous second colored coating composition (Y-1) obtained in Production Example 42; the plates were then subjected to evaluation tests.

(Preparation of Test Substrates to be Coated)

A cationic electrodeposition coating composition (trade name "Electron GT-10", manufactured by Kansai Paint Co., Ltd.) was applied to zinc phosphate conversion-coated, cold-rolled steel plates by electrodeposition to a film thickness of 20 μm (when cured), and cured by heating at 170° C. for 30 minutes to provide test substrates to be coated.

Example 1

The aqueous first colored coating composition (X-1) obtained in Production Example 20 was electrostatically applied to a test substrate to a film thickness of 20 μm (when cured) using a rotary atomizing electrostatic coating machine, then allowed to stand for 3 minutes, and preheated at 80° C. for 3 minutes. Subsequently, the aqueous second colored coating composition (Y-1) obtained in Production Example 42 was electrostatically applied to the uncured first colored coating film to a film thickness of 15 μm (when cured) using a rotary atomizing electrostatic coating machine. The coated substrate was allowed to stand for 5 minutes, and then preheated at 80° C. for 3 minutes. Subsequently, an acrylic resin solvent-based clear topcoat composition (trade name "MAGICRON KINO-1210", manufactured by Kansai Paint Co., Ltd.; hereinafter sometimes referred to as "clear coating composition (Z-1)"; the mixing ratio (mass ratio) of Solvesso 100/Solvesso 150/3-ethoxyethyl propionate/butanol/DBE used as solvents in the clear coating composition (Z-1) is 42/23/20/7.5/7.5 (DBE: a mixed solvent of glutaric acid dimethyl, succinic acid dimethyl, and dimethyl adipate; manufactured by Du Pont Kabushiki Kaisha)) was electrostatically applied to the uncured second colored coating film to a film thickness of 35 μm (when cured). The coated substrate was allowed to stand for 7 minutes, and then heated at 140° C. for 30 minutes. A multilayer coating film consisting of the first colored coating film, the second colored coating film, and the clear coating film was thereby cured to provide a test plate.

Examples 2 to 15 and Comparative Examples 1 to 5

Test plates were obtained in the same manner as in Example 1, except that the aqueous first colored coating compositions (X-2) to (X-20) shown in Table 3 were used in place of the aqueous first colored coating composition (X-1) obtained in Production Example 20.

Evaluation Test

Test plates obtained in Examples 1 to 15 and Comparative Examples 1 to 5 were evaluated according to the test methods described below. Table 3 shows the results of evaluation.

(Test Methods)

Smoothness: evaluated based on Wc value measured using "Wave Scan DOI" (manufactured by BYK Gardner). Wc value is an index of the amplitude of surface roughness of wavelengths ranging from about 1 to about 3 mm. The smaller the measured Wc value, the greater the smoothness of the coated surface.

Distinctness of image: evaluated based on Wa value measured using "Wave Scan DOI" (trade name, manufactured by BYK Gardner Co.). Wa value is an index of surface roughness amplitude at wavelengths ranging from about 0.1 to about 0.3 mm. The smaller the measured Wa value, the greater the distinctness of image of the coated surface.

Chipping resistance: each of the test plates was fixed to a sample holder of a gravel chipping tester (trade name "JA-400", manufactured by Suga Test Instruments Co., Ltd.), and 50 g of granite gravel having a particle size of 7 was sprayed onto the test plate at −20° C. by a compressed air of 0.392 MPa (4 kgf/cm$^2$) at an angle of 45° and a distance of 30 cm from the test plate. Subsequently, the resulting test plate was washed with water, and dried. A cloth adhesive tape (manufactured by Nichiban Co., Ltd.) was applied to the coated surface. Subsequently, the above tape was peeled off, and the degree of development of marring etc. on the coating film was observed with the naked eye and evaluated.

A: The amount of marring is small, and neither the electrocoated surface nor the substrate steel sheet was exposed.

B: The amount of marring is small, but the electrocoated surface or the substrate steel sheet was exposed.

C: The amount of marring is considerably large, and the substrate steel sheet is largely exposed.

High smoothness, high distinctness of image, and high chipping resistance are all important for coating compositions applied to automotive bodies or like substrates. Therefore, the test results were comprehensively evaluated according to the following criteria:

Comprehensive Evaluation:

A: Wc is not higher than 15, Wa is not higher than 17, and the chipping resistance is evaluated as A.

B: Wc is not higher than 15, Wa is not higher than 17, and the chipping resistance is evaluated as B.

C: Wc is more than 15, or Wa is more than 17, or the chipping resistance is evaluated as C.

Table 3 below shows the water swelling rate and solvent swelling rate of the first colored coating film obtained in each of the Examples and Comparative Examples, as well as the above test results.

TABLE 3

| | Example | | | | | | | | | | |
|---|---|---|---|---|---|---|---|---|---|---|---|
| | 1 | 2 | 3 | 4 | 5 | 6 | 7 | 8 | 9 | 10 | 11 |
| Aqueous first colored coating composition X- | 1 | 2 | 3 | 4 | 5 | 6 | 7 | 8 | 9 | 10 | 11 |
| First colored coating film | | | | | | | | | | | |
| Water swelling rate (%) | 63 | 48 | 80 | 39 | 98 | 77 | 20 | 26 | 38 | 21 | 18 |
| Organic solvent swelling rate (%) | 229 | 263 | 265 | 245 | 297 | 298 | 239 | 205 | 225 | 240 | 262 |
| Multilayer coating film | | | | | | | | | | | |
| Smoothness (Wc) | 13 | 12 | 12 | 11 | 13 | 14 | 9 | 9 | 11 | 9 | 12 |
| Distinctness of image (Wa) | 15 | 14 | 14 | 14 | 15 | 15 | 12 | 11 | 14 | 11 | 14 |
| Chipping resistance | A | A | A | A | A | A | A | A | A | A | A |
| Comprehensive evaluation | A | A | A | A | A | A | A | A | A | A | A |

| | Example | | | | Comparative Example | | | | |
|---|---|---|---|---|---|---|---|---|---|
| | 12 | 13 | 14 | 15 | 1 | 2 | 3 | 4 | 5 |
| Aqueous first colored coating composition X- | 12 | 13 | 14 | 15 | 16 | 17 | 18 | 19 | 20 |
| First colored coating film | | | | | | | | | |
| Water swelling rate (%) | 20 | 30 | 25 | 15 | 12 | 45 | 10 | 120 | 20 |
| Organic solvent-swelling rate (%) | 180 | 212 | 251 | 150 | 325 | 305 | 332 | 270 | 362 |
| Multilayer coating film | | | | | | | | | |
| Smoothness (Wc) | 8 | 11 | 10 | 7 | 16 | 16 | 17 | 20 | 19 |
| Distinctness of image (Wa) | 10 | 13 | 12 | 9 | 19 | 20 | 20 | 25 | 24 |
| Chipping resistance | A | A | A | A | C | A | C | B | C |
| Comprehensive evaluation | A | A | A | A | C | C | C | C | C |

The first colored coating films obtained in Comparative Examples 1 to 3 and 5 had low water swelling rates, but had high smoothness-indicating Wc values. This is due to a high organic solvent swelling rate of the first colored coating film attributable to the clear solvent contained therein.

The first colored coating film obtained in Comparative Example 4 had an organic solvent swelling rate of not higher than 300%, but a high smoothness-indicating Wc value. This is due to a high water swelling rate of the first colored coating film.

The results show that both of the water swelling rate and organic solvent swelling rate of the first colored coating film were the lowest in Example 15, thus indicating that the multilayer coating film obtained in Example 15 had the highest smoothness and the highest distinctness of image.

The invention claimed is:

1. A method for forming a multilayer coating film comprising sequentially performing the following steps (1) to (4) on a substrate:

step (1): forming a first colored coating film by applying an aqueous first colored coating composition (X);

step (2): forming a second colored coating film by applying an aqueous second colored coating composition (Y) on the first colored coating film formed in step (1);

step (3): forming a clear coating film by applying a clear coating composition (Z) on the second colored coating film formed in step (2); and step (4): bake-drying the first colored coating film, the second colored coating film, and the clear coating film formed in steps (1) to (3) all at once, wherein the aqueous first colored coating composition (X) is an aqueous coating composition comprising an acrylic resin (A), a curing agent (B), and a urethane resin emulsion (C), and the first colored coating film formed from the aqueous first colored coating composition (X) has a water swelling rate of 100% or less and an organic solvent swelling rate of 251% or less;

the urethane resin emulsion (C) is produced using a polyisocyanate component and a polyol component as starting materials;

the polyisocyanate component contains an alicyclic diisocyanate;

the polyol component contains a diol component;

the diol component contains a polycarbonate diol; and the polycarbonate diol is produced with a starting material comprising 50 mass % or more of a compound comprising a hydrocarbon group having 6 or more carbons.

2. The method for forming a multilayer coating film according to claim 1, wherein the urethane resin emulsion (C) is produced using the polyisocyanate component and the polyol component as starting materials, and the polyol component is used in an amount of 40to 90 mass % relative to the total mass of the polyisocyanate component and the polyol component.

3. The method for forming a multilayer coating film according to claim 2, wherein the acrylic resin (A) comprises a copolymer obtained through emulsion polymerization of a polymerizable unsaturated monomer mixture having an alkyl (meth)acrylate monomer having a $C_{4-14}$ alkyl group in an amount of 30 to 80 mass % relative to the total amount of polymerizable unsaturated monomers.

4. The method for forming a multilayer coating film according to claim 1, wherein the compound comprising the hydrocarbon group having 6 or more carbons is at least one selected from the group consisting of 1,6-hexanediol and 1,4-cyclohexane dimethanol.

5. The method for forming a multilayer coating film according to claim 4, wherein the acrylic resin (A) comprises a copolymer obtained through emulsion polymerization of a polymerizable unsaturated monomer mixture having an alkyl (meth)acrylate monomer having a $C_{4-14}$ alkyl group in an amount of 30 to 80 mass % relative to the total amount of polymerizable unsaturated monomers.

6. The method for forming a multilayer coating film according to claim 1, wherein the acrylic resin (A) comprises a copolymer obtained through emulsion polymerization of a polymerizable unsaturated monomer mixture having an alkyl (meth)acrylate monomer having a $C_{4-14}$ alkyl group in an amount of 30 to 80 mass % relative to the total amount of polymerizable unsaturated monomers.

7. The method for forming a multilayer coating film according to claim 1, wherein the curing agent (B) is at least one compound selected from the group consisting of a melamine resin (b-1), a polyisocyanate compound (b-2), a blocked polyisocyanate compound (b-3), and a carbodiimide group-containing compound (b-4).

8. The method for forming a multilayer coating film according to claim 1, wherein the aqueous first colored coating composition (X) comprises 20 to 70 mass % of the acrylic resin (A), 5 to 20 mass % of the curing agent (B), and 10 to 50 mass % of the urethane resin emulsion (C), based on the total weight of the solids content of the acrylic resin (A), the curing agent (B), and the urethane resin emulsion (C).

9. An article coated by the method for forming a multilayer coating film according to claim 1.

10. The method for forming a multilayer coating film according to claim 1, wherein the first colored coating film formed from the aqueous first colored coating composition (X) has a water swelling rate of 26% or less.

* * * * *